US008976205B2

(12) United States Patent
Shin et al.

(10) Patent No.: US 8,976,205 B2
(45) Date of Patent: Mar. 10, 2015

(54) METHOD OF DISPLAYING THREE-DIMENSIONAL STEREOSCOPIC IMAGE AND A DISPLAY APPARATUS FOR PERFORMING THE SAME

(75) Inventors: Yong-Hwan Shin, Yongin-si (KR); Baek-Kyun Jeon, Yongin-si (KR)

(73) Assignee: Samsung Display Co., Ltd. (KR)

( * ) Notice: Subject to any disclaimer, the term of this patent is extended or adjusted under 35 U.S.C. 154(b) by 247 days.

(21) Appl. No.: 13/612,504

(22) Filed: Sep. 12, 2012

(65) Prior Publication Data

US 2013/0215157 A1 Aug. 22, 2013

(30) Foreign Application Priority Data

Feb. 17, 2012 (KR) ..... 10-2012-0016435

(51) Int. Cl.

| | |
|---|---|
| ***G09G 5/10*** | (2006.01) |
| ***G09G 3/00*** | (2006.01) |
| ***G09G 3/36*** | (2006.01) |
| *G09G 3/34* | (2006.01) |

(52) U.S. Cl.

CPC ..... *G09G 3/003* (2013.01); *G09G 3/342* (2013.01); *G09G 3/3666* (2013.01); *G09G 3/3688* (2013.01); *G09G 2300/0426* (2013.01); *G09G 2310/0283* (2013.01); *G09G 2310/0297* (2013.01)

USPC ..... 345/690; 345/204; 345/419; 345/694

(58) Field of Classification Search

CPC ..... G09G 3/003; G09G 3/3666

See application file for complete search history.

(56) References Cited

U.S. PATENT DOCUMENTS

| | | | | |
|---|---|---|---|---|
| 2008/0238897 | A1* | 10/2008 | Kimura | 345/204 |
| 2010/0066820 | A1 | 3/2010 | Park et al. | |
| 2011/0149047 | A1 | 6/2011 | Min et al. | |
| 2011/0261034 | A1* | 10/2011 | Tsuchida et al. | 345/204 |
| 2012/0050240 | A1* | 3/2012 | Tanaka et al. | 345/204 |
| 2012/0050348 | A1* | 3/2012 | Kurokawa et al. | 345/690 |
| 2012/0127384 | A1* | 5/2012 | Miyake et al. | 349/15 |
| 2012/0162286 | A1* | 6/2012 | Toyotaka | 345/690 |

FOREIGN PATENT DOCUMENTS

KR 1020100073321 A 7/2010

* cited by examiner

*Primary Examiner* — Lixi C Simpson
(74) *Attorney, Agent, or Firm* — Innovation Counsel LLP

(57) ABSTRACT

A method of displaying a three-dimensional ("3D") stereoscopic image includes providing a first 3D data signal to a first display area portion of a display panel; and selectively providing a second 3D data signal or a black data signal to a second display area portion of the display panel when the first 3D data signal is being provided to the first display area.

20 Claims, 17 Drawing Sheets

METHOD OF DISPLAYING THREE-DIMENSIONAL STEREOSCOPIC IMAGE AND A DISPLAY APPARATUS FOR PERFORMING THE SAME

This application claims priority from and the benefit of Korean Patent Application No. 10-2012-0016435, filed on Feb. 17, 2012, which is hereby incorporated by reference for all purposes as if fully set forth herein.

BACKGROUND

1. Field of Disclosure

The present disclosure of invention relates to a method of displaying a three-dimensional ("3D") stereoscopic image to a user and a display apparatus for performing the above-mentioned method. More particularly, the present disclosure of invention relates to a method of displaying the 3D stereoscopic image where the method provides an increased driving efficiency and a display apparatus for performing the above-mentioned method.

2. Background

Generally, older conventional liquid crystal displays ("LCDs") displayed only a two-dimensional ("2D") image for perception as such by a human user. More recently, LCDs that display 3D images for perception as such by human users have been developed since demands for 3D imagery have increased in various fields such as computerized gaming, movies and so on.

Often, the 3D image display apparatus creates a perception of a 3D image for the corresponding audience by using the principle of binocular parallax through the two eyes of the human user. For example, since the two eyes of the human are spaced apart from each other and moved by the brain, the brain interprets images viewed at different angles from the respective eyes as being separate inputs that are to be combined in the brain of the human to create the perception of a 3D visualization. Thus, by separately defining the visual inputs to the left and right eyes of the observer, a machine-implemented system may create the impression that a 3D image as being observed based on the stereoscopically different images selectively passed through the display apparatus to the respective left and right eyes.

Stereoscopic image displaying devices may be classified into a stereoscopic type which uses an extra, special spectacle and an auto-stereoscopic type that does not rely on the extra spectacle. The spectacle-reliant stereoscopic type includes an analyph type, a liquid crystal shutter stereoscopic type and so on. In the analyph type, blue and red glasses for example are respectively worn by two eyes of the viewer. In the liquid crystal shutter stereoscopic type, a left image and a right image are temporally divided to be alternatively displayed, and the viewer wears glasses which sequentially open or close a left eye liquid crystal shutter and a right eye liquid crystal shutter in synchronization with the periods of display of the left and right images respectively.

SUMMARY

The present disclosure of invention provide a method of displaying a 3D stereoscopic image where the method is capable of increasing a driving efficiency of the display apparatus.

Additionally, the present disclosure of invention provides a display apparatus for performing the method of displaying the 3D stereoscopic image.

According to one aspect of the present disclosure, there is provided a method of displaying a 3D stereoscopic image where the method includes providing a first 3D data signal for rendering on a first display area portion of a display panel and selectively providing a second 3D data signal or a black data signal for rendering on a second display area portion of the display panel when the first 3D data signal is being provided for rendering on the first display area.

In an exemplary embodiment, the first 3D data signal or the black data signal may be sequentially provided to sequentially arranged blocks of the first display area portion and along a first spatial direction, and the second 3D data signal or the black data signal may simultaneously be sequentially provided to sequentially arranged blocks of the second display area portion also along the first spatial direction.

In an exemplary other embodiment or other mode, the first 3D data signal or the black data signal may be sequentially provided to the sequentially arranged blocks of the first display area portion along a first direction, and the second 3D data signal or the black data signal may be sequentially provided to the sequentially arranged blocks of the second display area portion along a second spatial direction that is opposite to (the reverse of) the first spatial direction.

In an exemplary embodiment, the second 3D data signal is sequentially provided to the sequentially arranged blocks of the second display area portion when the first 3D data signal is sequentially provided to the sequentially arranged blocks of the first display area portion.

In an exemplary embodiment, the method may further include providing the black data signal to the first display area portion and providing the black data signal to the second display area portion at the same time when the black data signal is provided to the first display area.

In an exemplary embodiment, the method may further include simultaneously controlling a turning on and off of a respective first light-emitting block and a respective second light-emitting block respectively corresponding to a first display block among the sequentially arranged blocks of the first display area and to a second display block among the sequentially arranged blocks of the second display area portion which display blocks simultaneously receive their respective first and second 3D data signals or the black data signal.

In an exemplary embodiment, the black data signal may be sequentially provided to the sequentially arranged blocks of the second display area portion when the first 3D data signal is being sequentially provided to the sequentially arranged blocks of the first display area.

In an exemplary embodiment, the method further may include providing the black data signal to the first display area portion and providing the second 3D data signal to the second display area portion when the black data signal is being provided to the first display area portion.

In an exemplary embodiment, the first and second display area portions may be arranged along a scanning direction of gate line activating signals of the display panel.

According to still another exemplary embodiment, there is provided a display apparatus. The display apparatus includes a display panel having a display area, a first gate circuit part, a second gate circuit part, a data driving part and a light-source part. The first gate circuit part sequentially provides a plurality of first gate signals to a plurality of gate lines of a first group disposed in a first display area portion of the display panel. The second gate circuit part sequentially provides a plurality of second gate signals to a plurality of gate lines of a second group disposed in a second display area portion of the display panel when the first gate signals are being sequentially provided to the gate lines of the first group. The data driving part provides a first 3D data signal to the first display area portion in synchronization with the first gate signals, and provides either a second 3D data signal or a black data signal to the second display area portion in synchronization with the second gate signals. The light-source part includes a plurality of light-emitting blocks which provide backlighting to the display panel.

In an exemplary embodiment, the first gate circuit part may sequentially provide the first gate signals to the gate lines of the first group along a first direction, and the second gate circuit part may sequentially provide the second gate signals to the gate lines of the second group along the first direction.

In an exemplary embodiment, the first gate circuit part may sequentially provide the first gate signals to the gate lines of the first group along a first direction, and the second gate circuit part may sequentially and simultaneously provide the second gate signals to the gate lines of the second group along a second direction opposite to the first direction.

In an exemplary embodiment, the data driving part may further include a first data circuit part disposed adjacent to a first long-side edge of the display panel and providing a data signal to pixels of the first display area portion, and a second data circuit part disposed adjacent to a second long-side edge of the display panel and providing corresponding data signals to pixels of the second display area portion, wherein the first display area portion is located between the first data circuit part and the second display area portion, and the second display area portion is located between the second data circuit part and the first display area portion.

In an exemplary embodiment, when the first data circuit part provides the first 3D data signal to the first display area portion, the second data circuit part may provide the second 3D data signal to the second display area portion, and when the first data circuit part provides the black data signal to the first display area portion, the second data circuit part may simultaneously provide the black data signal to the second display area portion.

In an exemplary embodiment, the display apparatus may further include a light-source driving part simultaneously controlling a first light-emitting block and a second light-emitting block respectively corresponding to a first display block of the first display area and a second display block of the second display area which simultaneously receive the respective first and second 3D data signals or the black data signal.

In an exemplary embodiment, the display panel may include a first data line electrically connected to sub-pixels disposed in the first display area portion among sub-pixels included in a pixel column of the display panel, and a second data line electrically connected to the sub-pixels disposed in the second display area portion among the sub-pixels included in the pixel column.

In an exemplary embodiment, the data driving part may include an integrated circuit part disposed in a peripheral area adjacent to a long-side edge of the display panel and outputting the first and second 3D data signals and a data selection part disposed in the peripheral area of the display panel and selectively providing a respective one or the other of the first and second 3D data signals or the black data signal to the first and second data lines.

In an exemplary embodiment, the data selection part may include a voltage line disposed in the peripheral area of the display panel and transferring the black data signal, a first switching part selectively connecting an output terminal of the integrated circuit part with the first and second data lines, and a second switching part selectively connecting the voltage line with the first and second data lines, wherein when the first switching part connects the first data line with the output terminal, the second switching part connects the second data line with the voltage line, and when the first switching part connects the second data line with the output terminal, the second switching part connects the first data line with the voltage line.

In an exemplary embodiment, the first and second display area portions may be arranged along a column direction of the display panel.

In an exemplary embodiment, the data driving part may include a flexible printed circuit board (FPCB) disposed in the peripheral area adjacent to a long-side edge of the display panel and a data selection part disposed on the FPCB and selectively providing the an appropriate one of the first and second 3D data signals or the black data signal to the first and second data lines.

According to the present disclosure of invention, the display area of the display panel is divided into the first display area portion and the second display area portion along a scanning direction and the first and second display areas are simultaneously driven, so that a frame frequency of the display panel 200 may be increased.

BRIEF DESCRIPTION OF THE DRAWINGS

The above and other features and advantages of the present disclosure of invention will become more apparent by describing in detailed exemplary embodiments thereof with reference to the accompanying drawings, in which.

DETAILED DESCRIPTION

Hereinafter, the present disclosure of invention will be provided in detail with reference to the accompanying drawings.

Figure 1:
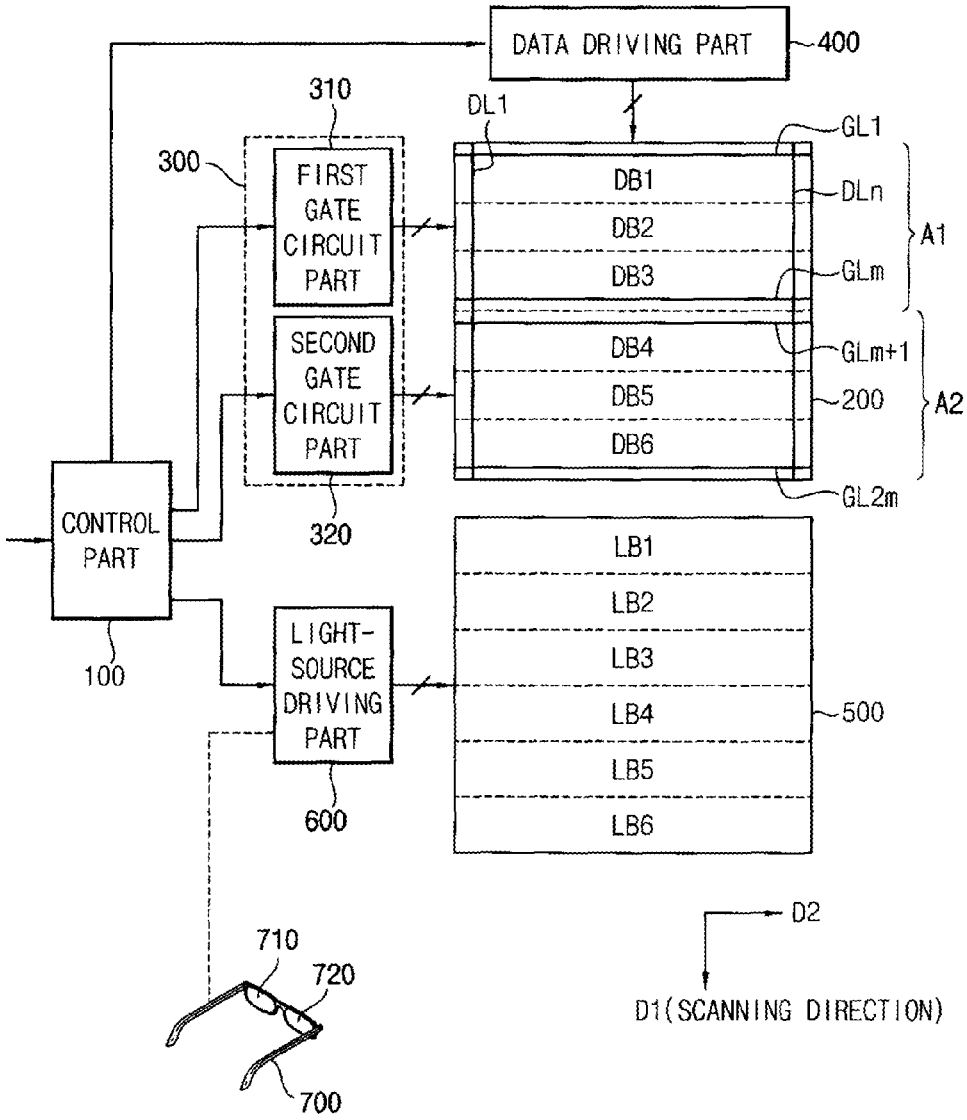
FIG. 1 is a block diagram illustrating an exemplary embodiment of a display apparatus according to the present disclosure.

FIG. 1 is a block diagram illustrating an exemplary embodiment of a display apparatus according to the present disclosure.

Referring to FIG. 1, the display apparatus includes an electronic control part 100, a display panel 200, a gate driving part 300, a data driving part 400, a light-source part 500, a light-source driving part 600 and a glasses part 700.

The control part 100 receives as one input thereto, one or more input signals representing one or both of two-dimensional ("2D") image data and three-dimensional ("3D") image data. The control part 100 controls a plurality of elements of the display apparatus including by placing them into a 2D image mode or a 3D image mode based on the received image data. The 3D image data may include a left-eye data portion and right-eye data portion.

The display panel 200 has a display area (DA) and includes a plurality of data lines, a plurality of gate lines and a plurality of pixels disposed in the display area (DA). The data lines DL1, . . . , DLn are extended in a first direction D1 and are arranged as spaced apart along a second direction D2 crossing the first direction D1. The gate lines GL1, . . . , GL2*m* are extended in the second direction D2 and are arranged as spaced apart along the first direction D1 (where n and m are natural numbers each greater than one). Each of the pixels may include a switching element connected to a corresponding data line and a corresponding gate line. Each pixel may further include a liquid crystal capacitor connected to and selectively driven by the switching element. The display area (DA) of the display panel 200 is subdivided into a plurality of area portions (e.g., A1 and A2). For example, the display panel may include a plurality of horizontally extending display blocks which are arranged as disposed adjacent to one another along a column direction such as the first direction D1. The respective horizontally extending display blocks (e.g., DB1-DB6) are each driven by a respective plurality or group of gate lines. Each gate line group may include a plurality of gate lines.

In the present exemplary embodiment, the display area is shown as divided into a first display area portion A1 and a second display area portion A2, where the dividing line extends in the horizontal or D2 direction. Respective imagery displayed by the display blocks (e.g., DB1-DB6) is refreshed along the column direction, that is in a scan direction D1, and the first and second display areas A1 and A2 may be both refreshed (repainted with new imagery) during a same frame. The data driving part 400 which provides data drive signals to the corresponding data lines (e.g., DL1-DLn) may be disposed adjacent to the top of the first display area portion A1.

The gate driving part 300 generates a plurality of gate signals and sequentially provides the gate signals to the gate lines. The gate driving part 300 includes a first gate circuit part 310 and a second gate circuit part 320. The first gate circuit part 310 sequentially provides respective first line-activating gate signals to first to m-th gate lines GL1, . . . , GLm disposed in the first display area portion A1 and corresponding to display blocks DB1-DB3. The sequence of the provided first line-activating gate signals (for GL1-GLm) may progress along a forward direction or a reverse direction with respect to the D1 direction. The second gate circuit part 320 sequentially provides respective second line-activating gate signals to the (m+1)-th to 2m-th gate lines GLm+1, . . . , GL2*m* disposed in the second display area portion A2 and corresponding to display blocks DB4-DB6 (as examples in FIG. 1). The sequence of the provided first line-activating gate signals (for GL(m+1)-GL(2m)) may progress along the forward direction or the reverse direction relative to the D1 direction. The first and second gate circuit parts 310 and 320 may be simultaneously driven in a same frame period (e.g., the Nth Frame period, N_F of FIG. 3).

The data driving part 400 converts digital image data received from the control part 100 into analog data signals, for instance, into analog drive voltages provides the generated data signals to respective ones of the data lines. More specifically, the data driving part 400 outputs the data signals respectively to the data lines DL1, . . . , DLn by use of a horizontal line unit, and in synchronization with gate line driving timings of the gate driving part 300.

The light-source part 500 generates a backlighting light which is provided to the display panel 200. In one embodiment, the light-source part 500 includes a light guide plate (LGP) and at least one light source disposed at an edge portion of the LGP. Alternatively, the light source part 500 may be of the direct-illumination type and then it includes at least one light source directly disposed under the display panel 200 and thus may not be requiring a LGP. The light-source 500 may use cold cathode or other types of elongated lamps and/or it may use light emitting diodes (LEDs, e.g., R, G, B and/or white). In one embodiment, the light-source part 500 is subdivided into a plurality of light-emitting blocks LB1, LB2, . . . , LB6 respectively corresponding to the display blocks DB1-DB6. Each of the light-emitting blocks LB1-LB6 may be selectively individually turned on or off and when turned on, selectively individually turned on to provide a respective intensity of backlighting luminance, controlled for example by a pulse width modulation (PWM) technique.

In the present exemplary embodiment of FIG. 1, the light-source part 500 includes six light-emitting blocks, however the present teachings are not limited thereto. The light-emitting blocks LB1, LB2, . . . , LB6 provide the corresponding backlighting light to respective display blocks DB1, DB2, . . . , DB6 of the display panel 200.

The light-source driving part 600 drives the light-emitting blocks LB1, LB2, . . . , LB6 in synchronization with the 2D or 3D images displayed from the corresponding display blocks DB1, DB2, . . . , DB6 and according to control signals provided by the control part 100. For example, a first light-emitting block may be turned on to provide the respective light to a corresponding first display block during a corresponding time period in which a respective one of the left-eye image or right-eye image is being displayed in correspondence with provision of the left-eye data signal or the right-eye data signal and opening of the left-eye shutter 710 or right-eye shutter 720 in the actively-shuttered glasses part 700. When a respective one of the left-eye image or right-eye image is not being displayed from a respective the display block (DBx), the corresponding light-emitting block (LBx) is turned off to thereby reduce power consumption and also to prevent leaked light from passing through the respective display block (DBx) during the time period during when only a black image corresponding to a provided black data signal is displayed by way of that display block (DBx; x=1, 2, 3, . . . ).

The glasses part 700 includes the aforementioned left-eye shutter 710 and a right-eye shutter 720. The glasses part 700 selectively opens and closes the left-eye shutter 710 and the right-eye shutter 720 according to control signals provided the control part 100 when in the 3D image mode. For example, the glasses part 700 opens the left-eye shutter 710 and closes the right-eye shutter 720 during a left-image displaying period during which only the left-eye image is being displayed on the display panel 200. The glasses part 700 closes left-eye shutter 710 and opens the right-eye shutter 720 during a right-image displaying period in which only the right-eye image is being displayed on the display panel 200.

In the present exemplary embodiment, the display panel is divided into the first display area portion A1 and the second display area portion A2 along the column direction as shown. It is to be understood that the position and the number of provided data driving parts (e.g., 400) and the position and the number of provided gate driving parts (e.g., 310, 320) may be changed, so that the display panel may be divided into more than the illustrative two display area portions (A1, A2) and so that the display area portions may be arranged in a row direction such as the second direction D2 as alternative to or in addition to being arranged in the illustrative column direction.

Figure 2:
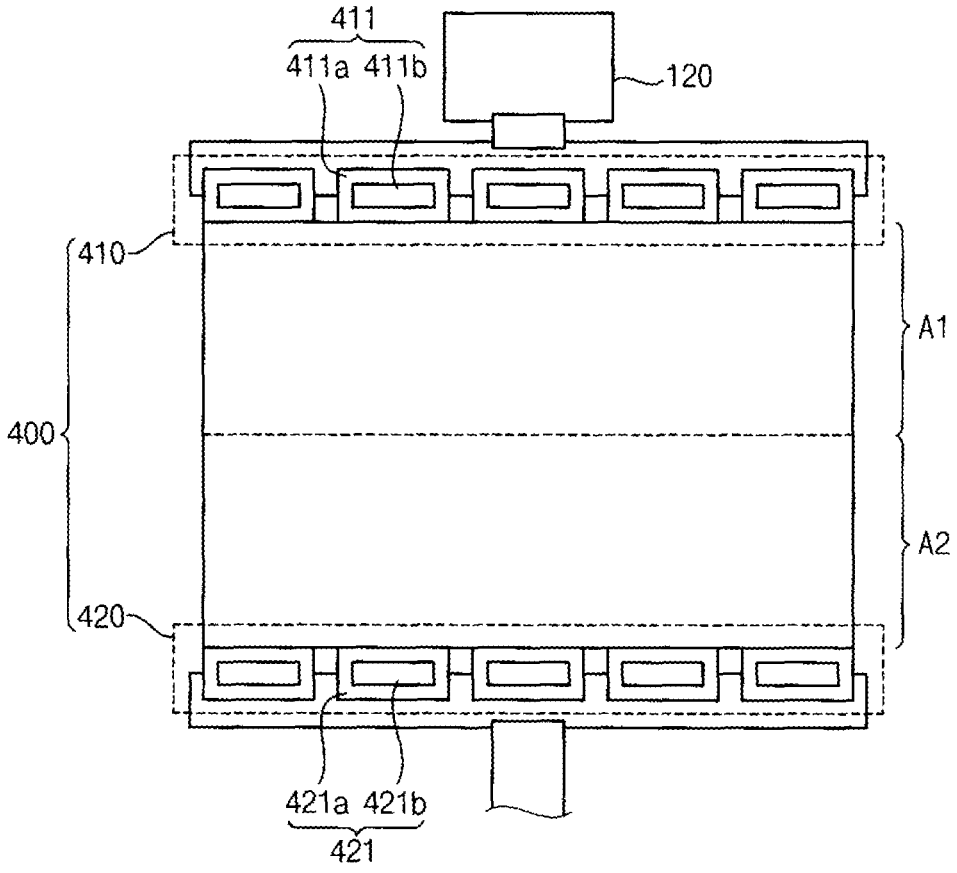
FIG. 2 is a plan view illustrating the display apparatus in FIG. 1.

FIG. 2 is a top plan view illustrating a possible layout for the display apparatus in FIG. 1.

Referring to FIG. 2, the display apparatus of the exemplary embodiment includes a main circuit board 120 on which there is mounted the control part 100 where the latter is electrically connected to the main circuit board 120 and the main circuit board 120 is electrically connected to the display panel 200 by way of one or more flexible printed circuit ribbon cables. In one embodiment, the data driving part 400 is at least partially mounted to one of the flexible printed circuit ribbon cables. The data driving part 400 includes a first data circuit part 410 disposed adjacent to a first longest-side edge of the display panel 200 and a second data circuit part 420 disposed adjacent to a second longest-side edge of the display panel 200 opposite to the first long-side edge. The display panel 200 includes a display area (DA) having the first display area portion A1 and the second display area portion A2, where the first display area portion A1 is located between the first data circuit part 410 and the second display area portion A2, and the second display area portion A2 is located between the second data circuit part 420 and the first display area portion A1.

The first data circuit part 410 provides corresponding first data signals to the first display area portion A1 of the display panel 200. The first data circuit part 410 includes at least one monolithically integrated circuit (IC) part 411 and the integrated circuit part 411 may include a flexible printed circuit board (FPCB) 411*a* and an integrated circuit 411*b* mounted on the FPCB 411*a*. The first data circuit part 410 outputs its data signals for refreshing corresponding horizontal lines of the first display area portion A1 where a then being-refreshed horizontal line corresponds to the gate line then receiving the row activating gate signal outputted from the first gate circuit part 310.

The second data circuit part 420 provides corresponding second data signals to the second display area portion A2 of the display panel 200. The second data circuit part 420 includes at least one corresponding integrated circuit part 421 and the integrated circuit part 421 may include a FPCB 421*a* and a monolithic integrated circuit 421*b* mounted on the FPCB 421*a*. The second data circuit part 420 outputs its data signals for refreshing corresponding horizontal lines of the second display area portion A2 where a then being-refreshed horizontal line of the second display area portion A2 corresponds to the row-activating gate signal then being outputted from the second gate circuit part 320.

Figure 3:
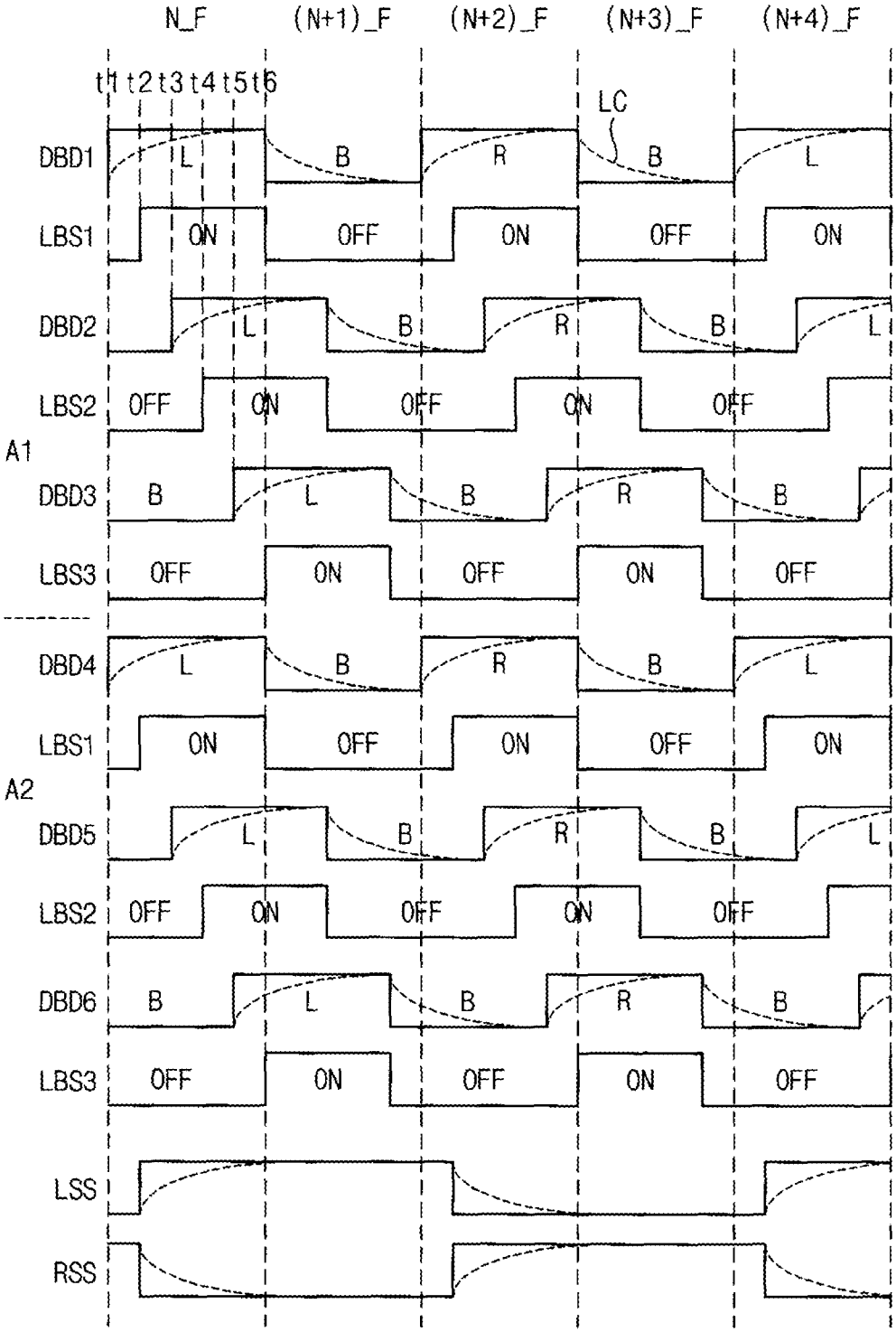
FIG. 3 is a waveform diagram illustrating a method of displaying a 3D stereoscopic image according to the display apparatus in FIG. 1.
Figure 4:
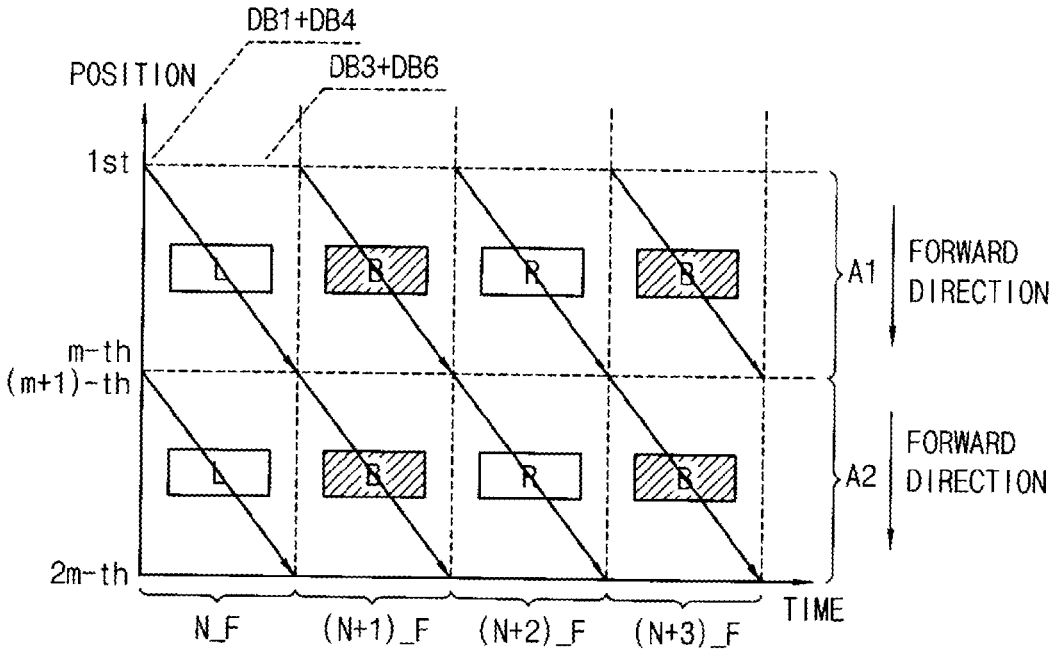
FIG. 4 is a schematic diagram illustrating the method of displaying the 3D stereoscopic image in FIG. 3.

FIG. 3 is a timing waveform diagram illustrating a method of displaying a 3D stereoscopic image according to the present disclosure and using the display apparatus of FIG. 1. FIG. 4 is a schematic diagram illustrating the method of displaying the 3D stereoscopic image in FIG. 3.

Referring to FIGS. 1 to 4, a method of driving the display panel 200 and the light-source part 500 during a frame is now described in more detail.

The first gate circuit part 310 sequentially provides line-activating gate signals to the first gate lines disposed in the first display area portion A1 of the display panel 200 where activation progresses along the forward direction. For example, the first gate circuit part 310 sequentially provides gate signals to first to m-th gate lines GL1, . . . , GLm. The first data circuit part 410 outputs respective data signals for painting (e.g., refreshing) the image of the horizontal line corresponding to the gate line then receiving the line-activating gate signal from the first gate circuit part 310. Thus, the refreshing of the image provided by the first display area portion A1 is driven in the same order as first, second and third display blocks DB1, DB2 and DB3.

The light-source driving part 600 sequentially and synchronously drives the first light-emitting block LB1, the second light-emitting block LB2 and then the third light-emitting block LB3 of the corresponding first display area portion A1 in the same order as, and in synchronism with the image refreshing operations of the first, second and third display blocks DB1, DB2 and DB3.

The second gate circuit part 320 sequentially provides the second gate signals to the corresponding gate lines disposed in the second display area portion A2 of the display panel 200 and along the forward direction and in synchronization with the first gate circuit part 310. For example, the second gate circuit part 320 sequentially provides the gate signals to (m+1)-th to 2m-th gate lines GLm+1, . . . , GL2*m*. The second data circuit part 420 simultaneously outputs the corresponding data signals for the horizontal image line corresponding to the gate line then receiving a line-activating gate signal from the second gate circuit part 320. Thus, the second display area portion A2 is driven (has its image refreshed) in the same order as fourth, fifth and sixth display blocks DB4, DB5 and DB6.

In the present exemplary embodiment, when the first gate circuit part 310 provides a first gate signal to a first gate line GL1 that is a first gate line with respect to the forward direction in the first display area portion A1, the second gate circuit part 320 provides an (m+1)-th gate signal to an (m+1)-th gate line that is a first gate line with respect to the forward direction in the second area portion A2. Similarly, when the first gate circuit part 310 provides an m-th gate signal to an m-th last gate line GLm that is a last gate line with respect to the forward direction in the first display area portion A1, the second gate circuit part 320 simultaneously provides a 2m-th gate signal to a 2m-th gate line GL2*m* that is a last gate line with respect to the forward direction in the second area portion A2.

Thus, the light-source driving part 600 sequentially drives the fourth light-emitting block LB4, the fifth light-emitting block LB5 and then the sixth light-emitting block LB6 corresponding to the second display area portion A2 driven in the same order as the occurrence of the fourth, fifth and sixth display blocks DB4, DB5 and DB6.

According to the present exemplary embodiment of FIGS. 1-4, when first light-emitting block LB1 is driven, the fourth light-emitting block LB4 is simultaneously driven. When the second light-emitting block LB2 is driven, the fifth light-emitting block LB5 is simultaneously driven. Similarly, when the third light-emitting block LB3 is driven, the sixth light-emitting block LB6 is simultaneously driven.

According to the present exemplary embodiment, a method of displaying the 3D image is described in yet more detail as follows.

Referring to the method of displaying the 3D image on the first and fourth display blocks DB1 and DB4, a left-eye data signal L is provided to the first and fourth display blocks DB1 and DB4 during a first period t1 of an N-th frame, N_F. Then a black data signal B is provided to the first and fourth display blocks DB1 and DB4 during a first period t1 of a next or (N+1)-th frame (N+1)_F. A right-eye data signal R is provided to the first and fourth display blocks DB1 and DB4 during a first period t1 of a third, or (N+2)-th frame (N+2)_F, and a black data signal B is provided to the first and fourth display blocks DB1 and DB4 during a first period t1 of a fourth, or (N+3)-th frame (N+3)_F. The 3D data signal may include the left-eye data signal L and the right-eye data signal R.

Based on which data signal (L or R) is being provided to the first and fourth display blocks DB1 and DB4, a first light-emitting signal LBS1 for simultaneously driving the first and fourth light-emitting blocks LB1 and LB4, is provided to the corresponding first and fourth light-emitting blocks LB1 and LB4. The first light-emitting signal LBS1 has a high level for turning on the respectively driven light-emitting blocks and a low level for turning off the respectively driven light-emitting blocks (e.g., LB1 and LB4).

The first light-emitting signal LBS1 has the high level during from a second period t2 of the N-th frame N_F at which the corresponding liquid crystal units have begun to latently respond to the left-eye data signal L supplied at the start of the first period t1. Before the first period t1 of the (N+1)-th frame (N+1)_F, a black data signal B had been provided to the first and fourth display blocks DB1 and DB4 and the corresponding liquid crystal units have been finishing their latent response behavior to that stimulus. (See also the dashed LC response curve to the B stimulus signal in the fourth, or (N+3)-th frame, (N+3)_F.)

The first light-emitting signal LBS1 is switched to have the low level during the first period t1 of the next, or (N+1)-th frame (N+1)_F which switching to low occurs before the second period t2 of the (N+2)-th frame (N+2)_F at which time the liquid crystal (LC) is starting to substantially respond to the right-eye data signal R then being applied. The first light-emitting signal LBS1 is switched to again have the high level during the second period t2 of the third, or (N+2)-th frame (N+2)_F where this continues to before the first period t1 of the fourth, or (N+3)-th frame (N+3)_F at which time the black data signal B is provided to the first and fourth display blocks DB1 and DB4. The first light-emitting signal LBS1 is switched to again have the low level from the first period t1 of the (N+3)-th frame (N+3)_F to the second period t2 of the fifth, or (N+4)-th frame (N+4)_F at which time the liquid crystal is responding to the next supplied left-eye data signal L.

Referring to the method of displaying the 3D image on the second and fifth display blocks DB2 and DB5, the left-eye data signal L is provided to the second and fifth display blocks DB2 and DB5 during a third period t3 of the N-th frame N_F. The subsequent black data signal B is provided to the second and fifth display blocks DB2 and DB5 during the third period t3 of the second, or (N+1)-th frame (N+1)_F, while the right-eye image data signal R is provided to the second and fifth display blocks DB2 and DB5 during the third period t3 of the (N+2)-th frame (N+2)_F. The black data signal B is provided to the second and fifth display blocks DB2 and DB5 during the third period t3 of the (N+3)-th frame (N+3)_F.

Based on the image data signal then being provided to the second and fifth display blocks DB2 and DB5, the second light-emitting signal LBS2 is provided as a high to the second and fifth display blocks DB2 and DB5.

The second light-emitting signal LBS2 has the high level from a fourth period t4 of the first, or N-th frame N_F at which a liquid crystal is responding to the left-eye data signal L where the high state of the LBS2 signal is continued to just before the third period t3 of the (N+1)-th frame (N+1)_F at which time the black data signal B is provided to the second and fifth display blocks DB2 and DB5. The second light-emitting signal LBS2 has the low level from the third period t3 of the (N+1)-th frame (N+1)_F to the fourth period t4 of the (N+2)-th frame (N+2)_F at which time the liquid crystal is responding to the then provided right-eye data signal R. The second light-emitting signal LBS2 has the high level from the fourth period t4 of the (N+2)-th frame (N+2)_F to the start of the third period t3 of the (N+3)-th frame (N+3)_F at which time the black data signal B is provided to the second and fifth display blocks DB2 and DB5. The second light-emitting signal LBS2 has the low level from the third period t3 of the (N+3)-th frame (N+3)_F to the start of the fourth period t4 of the (N+4)-th frame (N+4)_F at which time the liquid crystal is responding to the then provided left-eye data signal L.

Referring to the method of displaying the 3D image on the third and sixth display blocks DB3 and DB6, the left-eye data signal L is provided to the third and sixth display blocks DB3 and DB6 during a fifth period t5 of the N-th frame N_F, the black data signal B is provided to the third and sixth display blocks DB3 and DB6 during a fifth period t5 of the (N+1)-th frame (N+1)_F, the right-eye data signal R is provided to the third and sixth display blocks DB3 and DB6 during a fifth period t5 of the (N+2)-th frame (N+2)_F, and the black data signal B is provided to the third and sixth display blocks DB3 and DB6 during a fifth period t5 of the (N+3)-th frame (N+3)_F.

Based on the data signal then provided to the third and sixth display blocks DB3 and DB6, a third light-emitting signal LBS3 is simultaneously provided to the third and sixth display blocks DB3 and DB6.

The third light-emitting signal LBS3 has the high level from the start of a sixth period t6 of the N-th frame N_F at which a liquid crystal is responding to the left-eye data signal L to the start of the fifth period t5 of the (N+1)-th frame (N+1)_F at which time the black data signal B is provided to the third and sixth display blocks DB3 and DB6. The third light-emitting signal LBS3 has the low level during from the fifth period t5 of the (N+1)-th frame (N+1)_F to the start of a sixth period t6 of the (N+2)-th frame (N+2)_F at which time the liquid crystal is responding to the right-eye data signal R. The third light-emitting signal LBS3 has the high level from the sixth period t6 of the (N+2)-th frame (N+2)_F to the start of the fifth period t5 of the (N+3)-th frame (N+3)_F at which time the black data signal B is provided to the third and sixth display blocks DB3 and DB6. The third light-emitting signal LBS3 has the low level from the fifth period t5 of the (N+3)-th frame (N+3)_F to the start of a sixth period t6 of the (N+4)-th frame (N+4)_F at which the liquid crystal is responding to the left-eye data signal L.

Based on the method of driving the display panel 200 and the light-source part 500, the left-eye shutter signal LSS controls an operation of the left-eye shutter 710. The left-eye shutter signal LSS has a high level for opening the left-eye shutter 710 during a period corresponding to the N-th and (N+1)-th frames N_F and (N+1)_F during which the left-eye data signal L is provided to the display panel 200, the corresponding liquid crystals have begun to substantially respond and the corresponding light-emitting block LBx is turned on. The left-eye shutter signal LSS has a low level for closing the left-eye shutter 710 during a period corresponding to the (N+2)-th and (N+3)-th frames (N+2)_F and (N+3)_F during which the right-eye data signal R is provided to the display panel 200.

In addition, based on the method of driving the display panel 200 and the light-source part 500, the right-eye shutter signal RSS controls an operation of the right-eye shutter 720. The right-eye shutter signal RSS has a low level for closing the right-eye shutter 720 during a period corresponding to the N-th and (N+1)-th frames N_F and (N+1)_F during which the left-eye data signal L is provided to the display panel 200. The right-eye shutter signal RSS has a high level for opening the right-eye shutter 720 during a period corresponding to the (N+2)-th and (N+3)-th frames (N+2)_F and (N+3)_F during which the right-eye data signal R is provided to the display panel 200 and the corresponding liquid crystals have begun to substantially respond and the corresponding light-emitting block LBx is turned on.

According to the present exemplary embodiment, the display panel 200 is divided into at least the first display area portion A1 and the second display area portion A2, so that the first and second display area portions A1 and A2 are simultaneously driven with a first driving frequency. Thus, the display panel 200 may be driven with the lower first driving frequency rather than with a second driving frequency higher than the first driving frequency, where the higher second driving frequency would be used if all the display blocks DB1-DB6 had to be sequentially driven as a single series, one after another. In addition, the number of the light-emitting signals controlling the operations of the light-emitting blocks may be decreased because, for example, LBS1 is simultaneously supplied to both of light-emitting blocks LB1 and LB4; so that a circuit design of the light-source driving part may be simplified.

Figure 5:
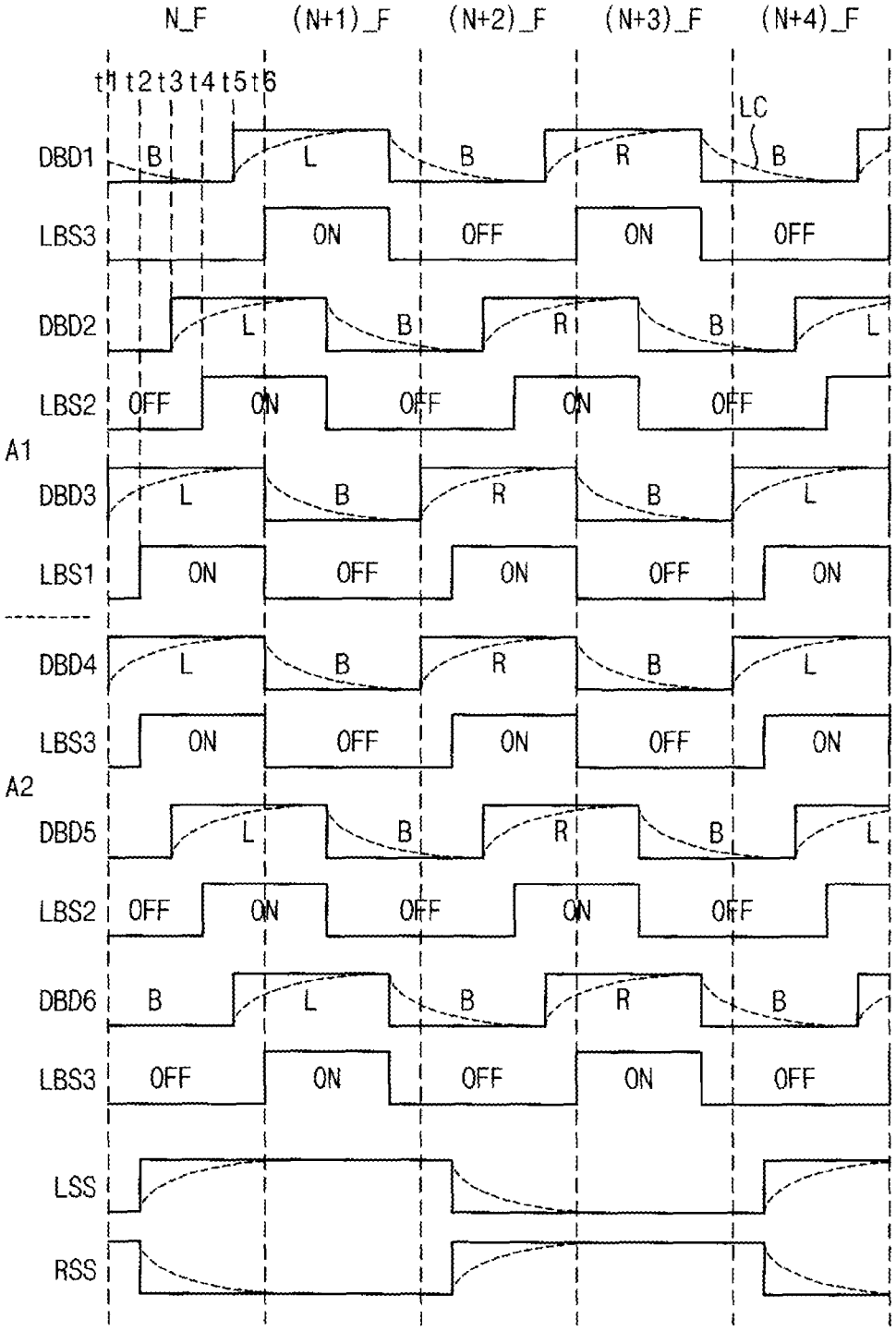
FIG. 5 is a waveform diagram illustrating an exemplary embodiment of a method of displaying a 3D stereoscopic image according to the present disclosure.
Figure 6:
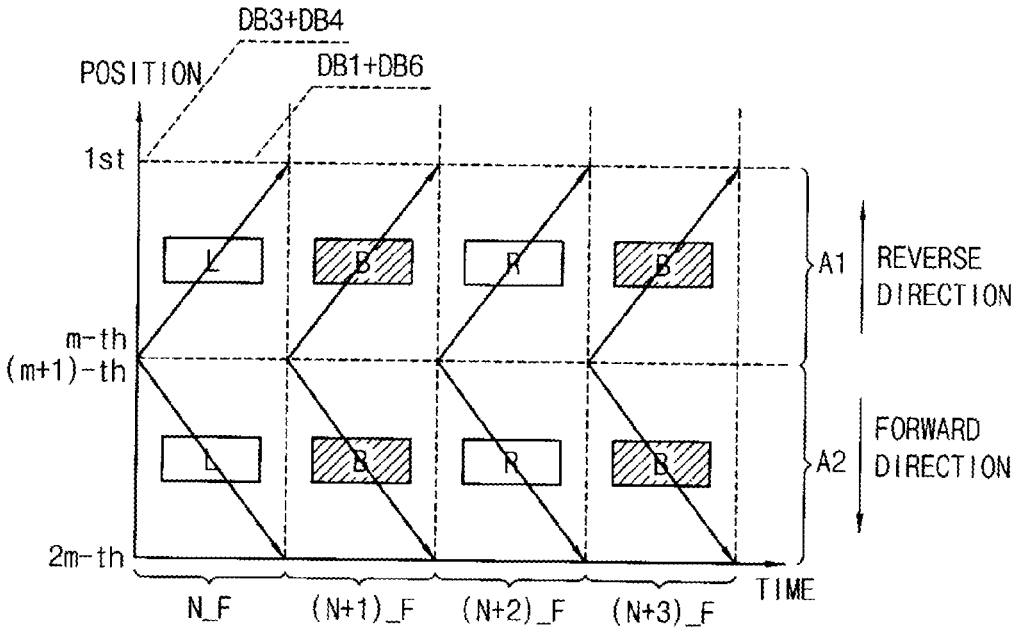
FIG. 6 is a schematic diagram illustrating the method of displaying the 3D stereoscopic image in FIG. 5.

FIG. 5 is a timing waveform diagram illustrating an exemplary embodiment of a second method of displaying a 3D stereoscopic image according to the present disclosure. FIG. 6 is a schematic diagram illustrating the method of displaying the 3D stereoscopic image in FIG. 5.

Referring to FIGS. 1, 2, 5 and 6, a method of driving the display panel 200 and the light-source part 500 during a frame is described in more detail.

The first gate circuit part 310 sequentially provides the gate signals to gate lines disposed in the first display area portion A1 of the display panel 200 along the reverse direction rather than the forward direction as was done in the first method. For example, the first gate circuit part 310 sequentially provides the gate signals to m-th to first gate lines GLm, . . . , GL1. The first data circuit part 410 outputs a data signal to a horizontal line corresponding to a gate line receiving a gate signal from the first gate circuit part 310. Thus, the first display area portion A1 is driven in the same order as third, second and first display blocks DB3, DB2 and DB1.

The light-source driving part 600 sequentially drives as the third light-emitting block LB3, the second light-emitting block LB2 and the first light-emitting block LB1 corresponding to the first display area portion A1 driven in the same order as the third, second and first display blocks DB3, DB2 and DB1.

The second gate circuit part 320 provides sequentially provides the gate signals to gate lines disposed in the second display area portion A2 of the display panel 200 along the forward direction in synchronization with the first gate circuit part 310. For example, the second gate circuit part 320 sequentially provides the gate signals to (m+1)-th to 2m-th gate lines GLm+1, . . . , GL2*m*. The second data circuit part 420 outputs a data signal to a horizontal line corresponding to a gate line receiving a gate signal from the second gate circuit part 320. Thus, the second display area portion A2 is driven in the same order as fourth, fifth and sixth display blocks DB4, DB5 and DB6.

In the present exemplary embodiment, when the first gate circuit part 310 provides an m-th gate signal to the m-th gate line GLm that is a first gate line with respect to the reverse direction in the first display area portion A1, the second gate circuit part 320 simultaneously provides an (m+1)-th gate signal to an (m+1)-th gate line that is a first gate line with respect to the forward direction in the second area portion A2. When the first gate circuit part 310 provides the first gate signal to the first gate line GL1 that is a last gate line with respect to the reverse direction in the first display area portion A1, the second gate circuit part 320 provides a 2m-th gate signal to a 2m-th gate line GL2*m* that is a last gate line with respect to the forward direction in the second area portion A2.

The light-source driving part 600 sequentially activates the fourth light-emitting block LB4, the fifth light-emitting block LB5 and the sixth light-emitting block LB6 corresponding to the second display area portion A2 driven in the same order as the fourth, fifth and sixth display blocks DB4, DB5 and DB6.

According to the present exemplary embodiment, when the third light-emitting block LB3 is driven, the fourth light-emitting block LB4 is simultaneously driven. When the second light-emitting block LB2 is driven, the fifth light-emitting block LB5 is simultaneously driven, and when the first light-emitting block LB1 is driven, the sixth light-emitting block LB6 is simultaneously driven.

According to the present exemplary embodiment, a method of displaying the 3D image is described in yet more detail.

Referring to the method of displaying the 3D image on the third and fourth display blocks DB3 and DB4, a left-eye data signal L is provided to the third and fourth display blocks DB3 and DB4 during a first period t1 of an N-th frame N_F, a black data signal B is provided to the third and fourth display blocks DB3 and DB4 during a first period t1 of an (N+1)-th frame (N+1)_F, a right-eye data signal R is provided to the third and fourth display blocks DB3 and DB4 during a first period t1 of an (N+2)-th frame (N+2)_F, and a black data signal B is provided to the third and fourth display blocks DB3 and DB4 during a first period t1 of an (N+3)-th frame (N+3)_F.

Based on the data signal provided to the third and fourth display blocks DB3 and DB4, a first light-emitting signal LBS1 is provided to the third and fourth light-emitting blocks LB3 and LB4. The first light-emitting signal LBS1 may have a phase that is substantially the same as a phase of the first light-emitting signal LBS1 described in FIGS. 3 and 4.

The method of displaying the 3D image on the second and fifth display blocks DB2 and DB5 may be substantially the same as those described in FIGS. 3 and 4, and the same detailed explanations are therefore not repeated here.

Referring to the method of displaying the 3D image on the first and sixth display blocks DB1 and DB6, the left-eye data signal L is provided to the first and sixth display blocks DB1 and DB6 during a fifth period t5 of the N-th frame N_F, the black data signal B is provided to the first and sixth display blocks DB1 and DB6 during a fifth period t5 of the (N+1)-th frame (N+1)_F, the right-eye data signal R is provided to the first and sixth display blocks DB1 and DB6 during a fifth period t5 of the (N+2)-th frame (N+2)_F, and the black data signal B is provided to the first and sixth display blocks DB1 and DB6 during a fifth period t5 of the (N+3)-th frame (N+3)_F.

Based on the data signal provided to the first and sixth display blocks DB1 and DB6, a third light-emitting signal LBS3 is provided to the first and sixth light-emitting blocks LB1 and LB6. The third light-emitting signal LBS3 may have a phase that is substantially the same as a phase of the third light-emitting signal LBS3 described in FIGS. 3 and 4.

The left-eye shutter signal LSS and the right-eye shutter signal RSS may be substantially the same as those described in FIGS. 3 and 4, and the same detailed explanations are therefore not repeated.

According to the present exemplary embodiment, the display panel 200 is divided into at least the first display area portion A1 and the second display area portion A2, so that the first and second display area portions A1 and A2 are simultaneously driven with a relatively low, first driving frequency. This is opposed to where the display panel 200 may otherwise have to be driven with a second driving frequency higher than the first driving frequency if the display area (DA) was not divided into simultaneously driven first and second display area portions A1 and A2. In addition, the number of the light-emitting signals controlling the operations of the light-emitting blocks may be decreased so that a circuit design of the light-source driving part may be simplified.

Figure 7:
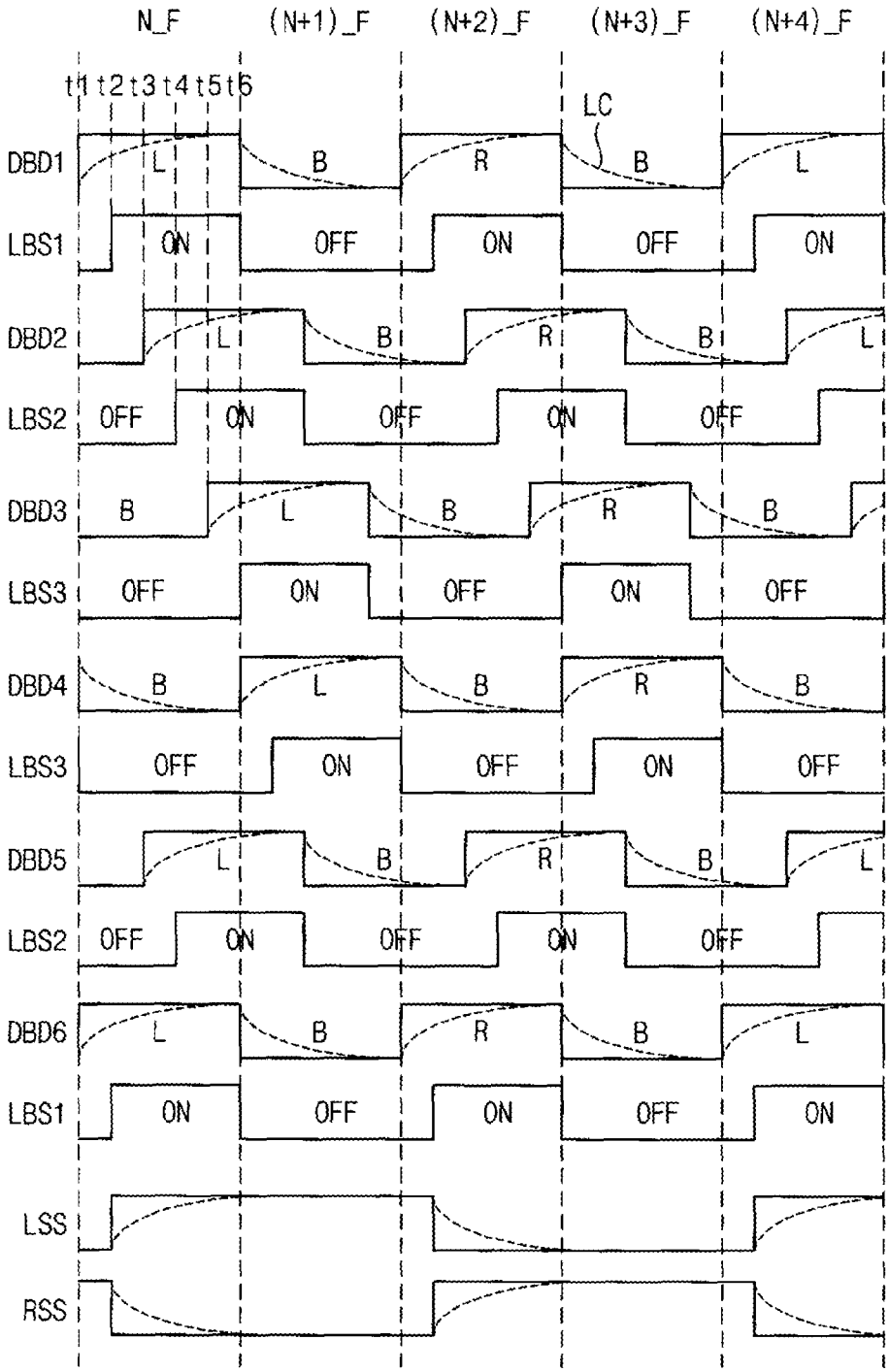
FIG. 7 is a waveform diagram illustrating an exemplary embodiment of a method of displaying a 3D stereoscopic image according to the present disclosure.
Figure 8:
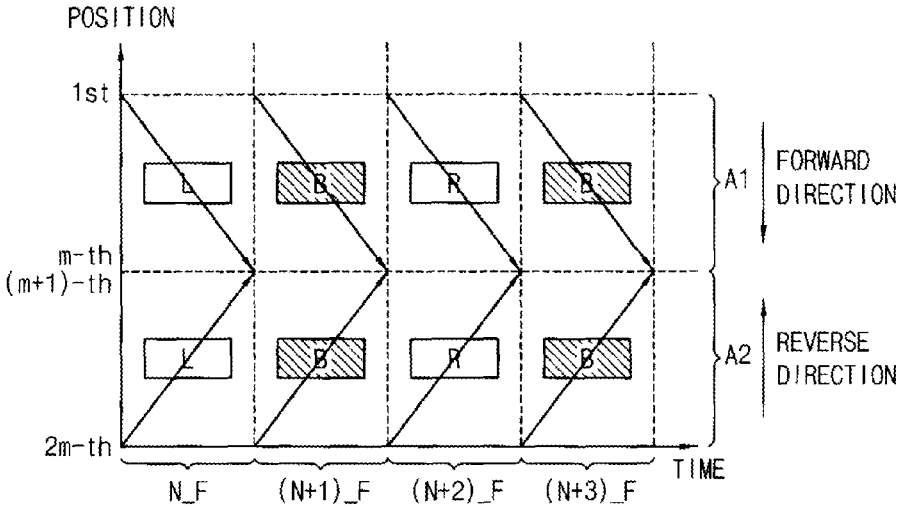
FIG. 8 is a schematic diagram illustrating the method of displaying the 3D stereoscopic image in FIG. 7.

FIG. 7 is a timing waveform diagram illustrating an exemplary embodiment of a method of displaying a 3D stereoscopic image according to the present invention. FIG. 8 is a schematic diagram illustrating the method of displaying the 3D stereoscopic image in FIG. 7

Referring to FIGS. 1, 2, 7 and 8, a third method of driving the display panel 200 and the light-source part 500 during a frame is described in more detail.

The first gate circuit part 310 sequentially provides the gate signals to gate lines disposed in the first display area portion A1 of the display panel 200 along the forward direction as in the first described method. For example, the first gate circuit part 310 sequentially provides the gate signals to first to m-th gate lines GL1, . . . , GLm. The first data circuit part 410 outputs a data signal to a horizontal line corresponding to a gate line receiving a gate signal from the first gate circuit part 310. Thus, the first display area portion A1 is driven in the same order as first, second and third display blocks DB1, DB2 and DB3.

The light-source driving part 600 sequentially drives the first light-emitting block LB1, the second light-emitting block LB2 and the third light-emitting block LB3 corresponding to the first display area portion A1 driven in the same order as the first, second and third display blocks DB1, DB2 and DB3.

However, in this third driving method, the second gate circuit part 320 provides sequentially provides the gate signals to gate lines disposed in the second display area portion A2 of the display panel 200 along the reverse direction in synchronization with the first gate circuit part 310. For example, the second gate circuit part 320 sequentially provides gate signals to (2m)-th to (m+1)-th gate lines GL2*m*, . . . , GLm+1. The second data circuit part 420 outputs a data signal to a horizontal line corresponding to a gate line receiving a gate signal from the second gate circuit part 320. Thus, the second display area portion A2 is driven in the same order as sixth, fifth and fourth display blocks DB6, DB5 and DB4.

In the present exemplary embodiment, when the first gate circuit part 310 provides a first gate signal to the first gate line GL1 that is a first gate line with respect to the forward direction in the first display area portion A1, the second gate circuit part 320 simultaneously provides an 2m-th gate signal to the 2m-th gate line that is a first gate line with respect to the reverse direction in the second area portion A2. When the first gate circuit part 310 provides an m-th gate signal to the m-th gate line GLm that is a last gate line with respect to the forward direction in the first display area portion A1, the second gate circuit part 320 provides an (m+1)-th gate signal to the (m+1)-th gate line GLm+1 that is a last gate line with respect to the reverse direction in the second area portion A2.

The light-source driving part 600 sequentially drives the sixth light-emitting block LB6, the fifth light-emitting block LB5 and the fourth light-emitting block LB4 corresponding to the second display area portion A2 driven in the same order as the sixth, fifth and fourth display blocks DB6, DB5 and DB4.

According to the present exemplary embodiment, a method of displaying the 3D image is described in more detail.

Referring to the method of displaying the 3D image on the first and sixth display blocks DB1 and DB6, a left-eye data signal L is provided to the first and sixth display blocks DB1 and DB6 during a first period t1 of an N-th frame N_F, a black data signal B is provided to the first and sixth display blocks DB1 and DB6 during a first period t1 of an (N+1)-th frame (N+1)_F, a right-eye data signal R is provided to the first and sixth display blocks DB1 and DB6 during a first period t1 of an (N+2)-th frame (N+2)_F, and a black data signal B is provided to the first and sixth display blocks DB1 and DB6 during a first period t1 of an (N+3)-th frame (N+3)_F.

Based on the data signal provided to the first and sixth display blocks DB1 and DB6, a first light-emitting signal LBS1 is provided to the first and sixth light-emitting blocks LB1 and LB6. The first light-emitting signal LBS1 may have a phase that is substantially the same as a phase of the first light-emitting signal LBS1 described in FIG. 3.

The method of displaying the 3D image on the second and fifth display blocks DB2 and DB5 may be substantially the same as those described in FIGS. 3 and 4, and the same detailed explanations are therefore not repeated.

Referring to the method of displaying the 3D image on the third and fourth display blocks DB3 and DB4, the left-eye data signal L is provided to the third and fourth display blocks DB3 and DB4 during a fifth period t5 of the N-th frame N_F, the black data signal B is provided to the third and fourth display blocks DB3 and DB4 during a fifth period t5 of the (N+1)-th frame (N+1)_F, the right-eye data signal R is provided to the third and fourth display blocks DB3 and DB4 during a fifth period t5 of the (N+2)-th frame (N+2)_F, and the black data signal B is provided to the third and fourth display blocks DB3 and DB4 during a fifth period t5 of the (N+3)-th frame (N+3)_F.

Based on the data signal provided to the third and fourth display blocks DB3 and DB4, a third light-emitting signal LBS3 is provided to the first and sixth light-emitting blocks LB1 and LB6. The third light-emitting signal LBS3 may have a phase that is substantially the same as a phase of the third light-emitting signal LBS3 described in FIG. 3.

The left-eye shutter signal LSS and the right-eye shutter signal RSS may be substantially the same as those described in FIGS. 3 and 4, and the same detailed explanations are therefore not repeated.

According to the present exemplary embodiment, the display panel 200 is divided at least into the first display area portion A1 and the second display area portion A2, so that the first and second display area portions A1 and A2 are simultaneously driven with a relatively low first driving frequency. Otherwise, the display panel 200 would have to be driven with a second driving frequency higher than the first driving frequency. In addition, the number of the light-emitting signals controlling the operations of the light-emitting blocks may be decreased so that a circuit design of the light-source driving part may be simplified.

Figure 9:
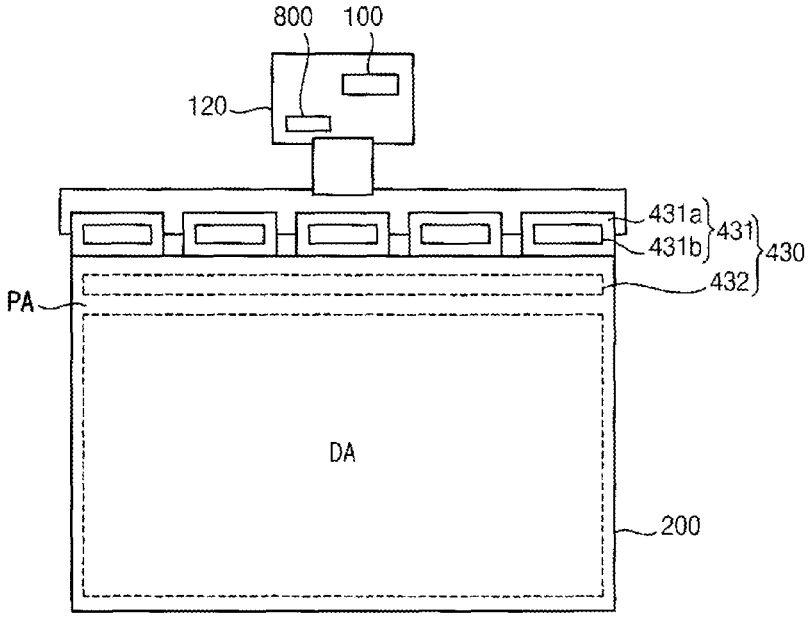
FIG. 9 is a plan view illustrating an exemplary embodiment of a display apparatus according to the present disclosure.
Figure 10:
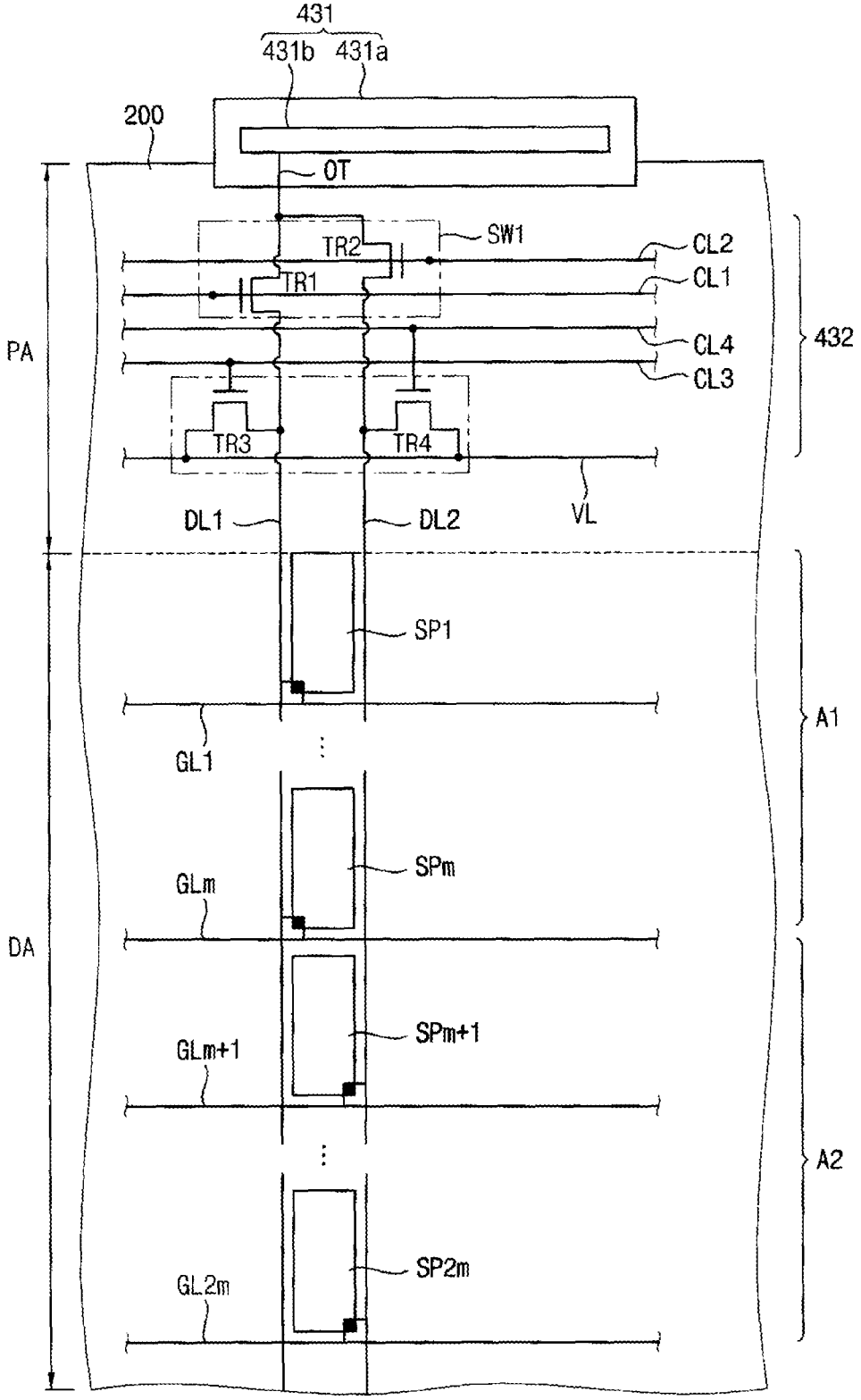
FIG. 10 is a schematic diagram illustrating a data driving part of FIG. 9.

FIG. 9 is a top plan view illustrating a layout of an exemplary further embodiment of a display apparatus according to the present disclosure. FIG. 10 is a schematic diagram illustrating a data driving part of FIG. 9.

Hereinafter, the same reference numerals are used to refer to the same or like parts as those described in the previous exemplary embodiments, and the same detailed explanations are thus not repeated.

Referring to FIGS. 1, 9 and 10, the display apparatus according to the present exemplary embodiment includes a main circuit board 120, a display panel 200 and a data driving part 430.

The main circuit board 120 includes a control part 100 and a voltage generating part 800, and the control part 100 and a voltage generating part 800 are mounted on the main circuit board 120.

The display panel 200 includes a display area DA and a peripheral area PA surrounding the display area DA. As in the previous examples, the display area DA is subdivided into at least first and second display area portions (e.g., A1 and A2).

More specifically, the display area DA includes a plurality of data lines, a plurality of gate lines and a plurality of sub pixels, and is divided into at least the aforementioned first display area portion A1 and the second display area portion A2. The sub pixels may be arranged as a matrix type which includes a plurality of pixel rows and a plurality of pixel columns. The sub pixels included in the pixel column PC are connected to a first data line DL1 disposed at a first side of the pixel column PC (and corresponding to the first display area portion A1). Some of the sub pixels included in the pixel column PC are alternatively connected to a second data line DL2 disposed at a second side of the pixel column PC (and corresponding to the second display area portion A2). More specifically, the sub pixels SP1, . . . SPm of a first group disposed in the first display area portion A1 are electrically operatively coupled to the first data line DL1 and the sub pixels SPm+1, . . . , SP2*m* of a second group disposed in the second display area portion A2 are electrically operatively coupled to the second data line DL2.

The data driving part 430 includes at least one integrated circuit part 431 which is mounted in the peripheral area PA corresponding to a first long-side of the display panel 200 and a data selection part 432 formed in the peripheral area PA of the display panel 200 adjacent to the integrated circuit part 431.

The integrated circuit part 431 may include a FPCB 431*a* and an integrated circuit 431*b* mounted on the FPCB 431*a*.

The data selection part 432 includes a first switching part SW1, a second switching part SW2, a plurality of control lines CL1, CL2, CL3 and CL4 and a voltage line VL (e.g., a Black signal providing voltage line).

The first switching part SW1 includes a first transistor TR1 and a second transistor TR2. The first transistor TR1 connected to a first control line CL1, an outputting terminal OT of the integrated circuit part 431 and the first data line DL1. The second transistor TR2 is connected to a second control line CL2, the outputting terminal OT and the second data line DL2.

The first and second control lines CL1 and CL2 respectively transfer a first control signal and a second control signal received from the control part 100.

The first switching part SW1 provides a left-eye signal or a right-eye data signal outputted from the outputting terminal OT to the first data line DL1 or the second data line DL2 based on the first and second control signals of the control part 100 respectively transferred through the first and second control lines CL1 and CL2.

For example, when the first control line CL1 receives a high signal and the second control line CL2 receives a low signal, the first switching part SW1 transfers the left-eye data signal or the right-eye data signal outputted from the outputting terminal OT to the first data line DL1. However, when the first control line CL1 receives a low signal and the second control line CL2 receives a high signal, the first switching part SW1 transfers the left-eye data signal or the right-eye data signal outputted from the outputting terminal OT to the second data line DL2.

The second switching part SW2 includes a third transistor TR3 and a fourth transistor TR4. The third transistor TR3 is connected to a third control line CL3, the voltage line VL and the first data line DL1. The fourth transistor TR4 is connected to a fourth control line CL4, the voltage line VL and the second data line DL2.

The third and fourth control lines CL3 and CL4 transfer a third control signal and fourth control signal received from the control part 100.

The voltage line VL transfers the black data signal (B) received from the voltage generating part 800. The black data signal may have a fixed (predefined) level such as a direct current (DC) voltage that causes the correspondingly driven LC cells to produce a black or other dark grayscale level.

The second switching part SW2 provides the black data signal transferred through voltage line VL to the first data line DL1 or the second data line DL2 based on the third and fourth control signals of the control part 100 transferred through the third and fourth control lines CL3 and CL4.

For example, when the third control line CL3 receives a high signal and the fourth control line CL4 receives a low signal, the second switching part SW2 transfers the black data signal transferred through the voltage line VL to the first data line DL1. However, when the third control line CL3 receives a low signal and the fourth control line CL4 receives a low signal, the second switching part SW2 transfers the black data signal transferred through the voltage line VL to the second data line DL2.

According to the present exemplary embodiment, the number of the integrated circuits included in the data driving part may be decreased in comparison with the previous exemplary embodiment in FIG. 2.

Figure 11:
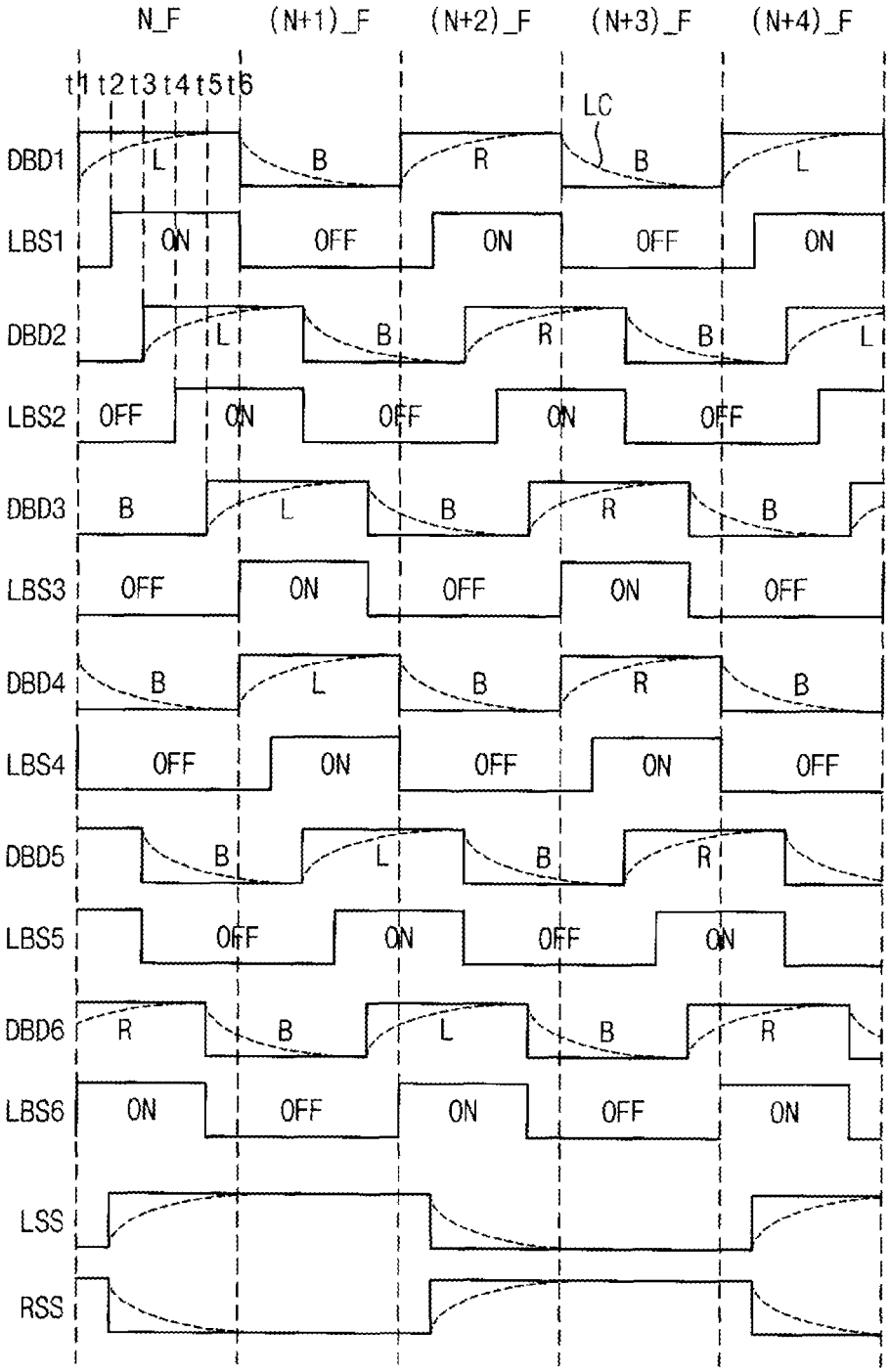
FIG. 11 is a waveform diagram illustrating a method of displaying the 3D stereoscopic image according to the display apparatus in FIG. 10.
Figure 12:
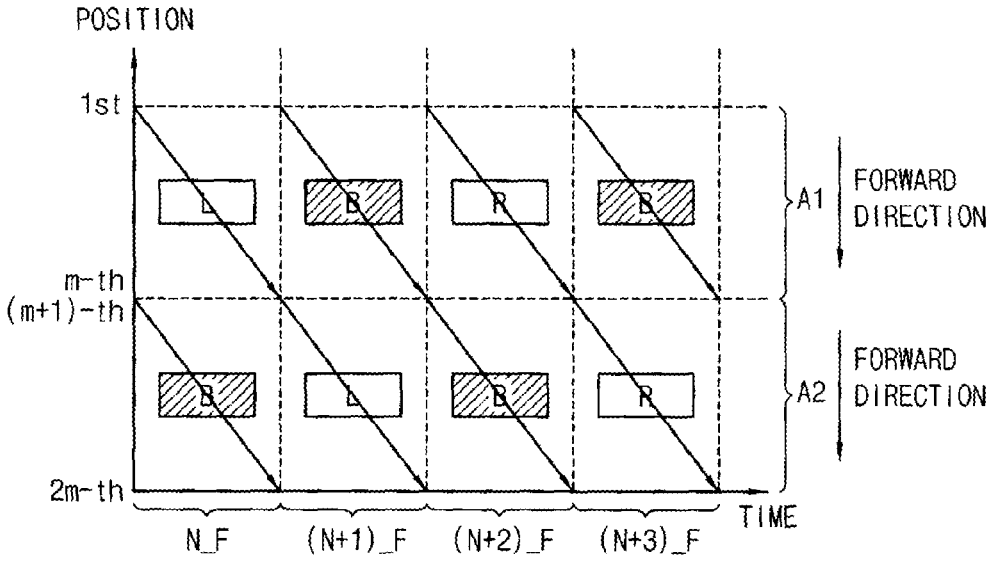
FIG. 12 is a schematic diagram illustrating the method of displaying the 3D stereoscopic image in FIG. 11.
Figure 13A:
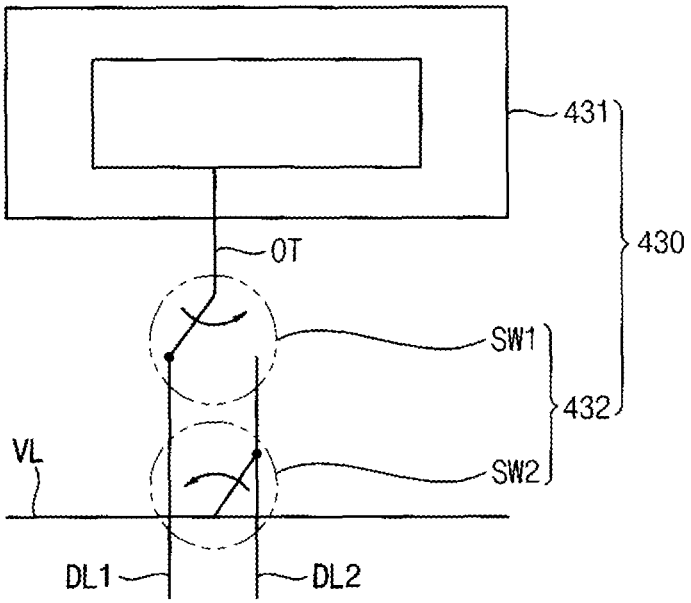
FIGS. 13A and 13B are schematic diagrams illustrating driving a data selection part in FIG. 10.
Figure 13B:
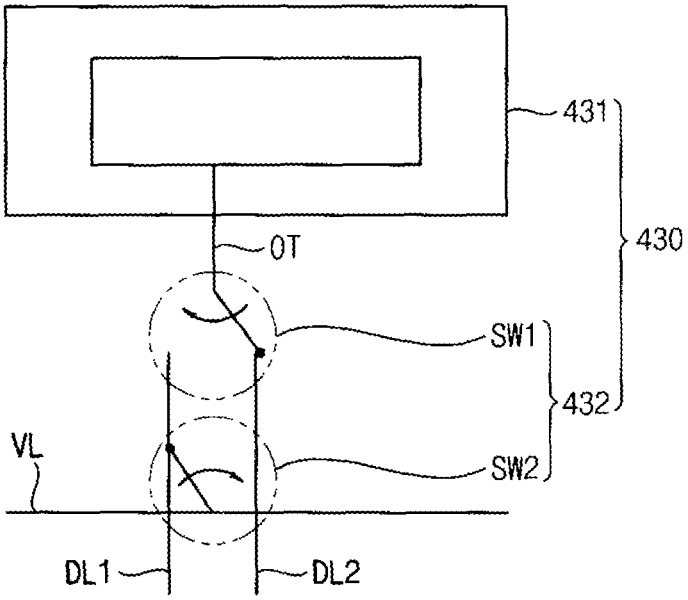

FIG. 11 is a waveform diagram illustrating a method of displaying the 3D stereoscopic image according to the display apparatus in FIG. 10. FIG. 12 is a schematic diagram illustrating the method of displaying the 3D stereoscopic image in FIG. 11. FIGS. 13A and 13B are schematic diagrams illustrating driving a data selection part in FIG. 10.

Referring to FIGS. 1, 11 and 12, a machine-implemented method of driving a gate driving part 300 may be substantially the same as those described in FIGS. 3 and 4. For example, the first gate circuit part 310 sequentially provides gate signals to gate lines disposed in the first display area portion A1 of the display panel 200 to along a forward direction. For example, the first gate circuit part 310 sequentially provides the gate signals to first to m-th gate lines GL1, . . . , GLm. The second gate circuit part 320 sequentially provides gate signals to gate lines disposed in the second display area portion A2 of the display panel 200 to along the forward direction in synchronization with the first gate circuit part 310. For example, the second gate circuit part 320 sequentially provides gate signals to (m+1)-th to 2m-th gate lines GLm+1, . . . , GL2*m*, when the first gate circuit part 310 sequentially provides the gate signals to first to m-th gate lines GL1, . . . , GLm.

In the present exemplary embodiment, when the data driving part 430 provides the left-eye data signal or the right-eye data signal to the first display area portion A1 of the display panel 200, the data driving part 430 provides the black data signal to the second display area portion A2 of the display panel 200. However, when the data driving part 430 provides the black data signal to the first display area portion A1 of the display panel 200, the data driving part 430 provides the left-eye data signal or the right-eye data signal to the second display area portion A2 of the display panel 200.

Referring to FIGS. 13A and 13B, the outputting terminal OT of the integrated circuit part 431 outputs the left-eye data signal or the right-eye data signal. The voltage line VL receives the black data signal.

During an odd-numbered frame, the first switching part SW1 of the data selection part 431 is electrically connected to the first data line DL1 connected to the sub pixels disposed in the first display area portion A1 so that the sub pixels disposed in the first display area portion A1 are appropriately receiving the left-eye data signal or the right-eye data signal outputted from the outputting terminal OT. In addition, the second switching part SW2 of the data selection part 431 is electrically connected to the second data line DL2 connected to the sub pixels disposed in the second display area portion A2 so that the sub pixels disposed in the second display area portion A2 are instead receiving the black data signal transferred through the voltage line VL.

During an even-numbered frame, the first switching part SW1 of the data selection part 431 is electrically connected to the second data line DL2 connected to the sub pixels disposed in the second display area portion A2 so that the sub pixels disposed in the second display area portion A2 are receiving the left-eye data signal or the right-eye data signal outputted from the outputting terminal OT. In addition, the second switching part SW2 of the data selection part 431 is electrically connected to the first data line DL1 connected to the sub pixels disposed in the first display area portion A1 so that the sub pixels disposed in the first display area portion A1 receive the black data signal transferred through the voltage line VL.

According to the present exemplary embodiment, a method of displaying the 3D image is described in more detail.

Referring to the method of displaying the 3D image on the first and fourth display blocks DB1 and DB4, during a first period t1 of an N-th frame N_F, a left-eye data signal L is provided to the first display block DB1 and a black data signal B is simultaneously provided to the fourth display block DB4. During a first period t1 of an (N+1)-th frame (N+1)_F, the black data signal B is provided to the first display block DB1 and the left-eye data signal L is provided to the fourth display block DB4. During a first period t1 of an (N+2)-th frame (N+2)_F, the right-eye data signal R is provided to the first display block DB1 and the black data signal B is provided to the fourth display block DB4. During a first period t1 of an (N+3)-th frame (N+3)_F, the black data signal B is provided to the first display block DB1 and the right-eye data signal R is provided to the fourth display block DB4.

Based on the data signal provided to each of the first and fourth display blocks DB1 and DB4, a first light-emitting signal LBS1 and a fourth light-emitting signal LBS4 for driving the first and fourth light-emitting blocks LB1 and LB4 are respectively provided to the first and fourth light-emitting blocks LB1 and LB4.

The first light-emitting signal LBS1 has the high level during from a second period t2 of the N-th frame N_F at which a liquid crystal of the first display block DB1 is responded to the left-eye data signal L to before the first period t1 of the (N+1)-th frame (N+1)_F at which the black data signal B is provided to the first display block DB1. The first light-emitting signal LBS1 has the low level during from the first period t1 of the (N+1)-th frame (N+1)_F to before a second period t2 of the (N+2)-th frame (N+2)_F at which the liquid crystal of the first display block DB1 is responded to the right-eye data signal R. The first light-emitting signal LBS1 has the high level during from a second period t2 of the (N+2)-th frame (N+2)_F to before the first period t1 of the (N+3)-th frame (N+3)_F at which the black data signal B is provided to the first display block DB1. The first light-emitting signal LBS1 has the low level during from the first period t1 of the (N+3)-th frame (N+3)_F to before a second period t2 of the (N+4)-th frame (N+4)_F at which the liquid crystal of the first display block DB1 is responded to the left-eye data signal L.

The fourth light-emitting signal LBS4 has the low level during from the first period t1 of the N-th frame N_F to the start of the second period t2 of the (N+1)-th frame (N+1)_F at which the liquid crystal of the fourth display block DB4 is responded to the left-eye data signal L. The fourth light-emitting signal LBS4 has the high level during from the second period t2 of the (N+1)-th frame (N+1)_F to the start of the first period t1 of the (N+2)-th frame (N+2)_F at which the black data signal B is provided to the fourth display block DB4. The fourth light-emitting signal LBS4 has the low level during from the first period t1 of the (N+2)-th frame (N+2)_F to the start of the second period t2 of the (N+3)-th frame (N+3)_F at which the liquid crystal of the fourth display block DB4 is responded to the right-eye data signal R. The fourth light-emitting signal LBS4 has the high level during from the second period t2 of the (N+4)-th frame (N+4)_F to the start of the first period t1 of the (N+4)-th frame (N+4)_F at which the black data signal B is provided to the fourth display block DB4.

Referring to the method of displaying the 3D image on the second and fifth display blocks DB2 and DB5, during a third period t3 of the N-th frame N_F, a left-eye data signal L is provided to the second display block DB2 and a black data signal B is provided to the fifth display block DB5. During a third period t3 of the (N+1)-th frame (N+1)_F, the black data signal B is provided to the second display block DB2 and the left-eye data signal L is provided to the fifth display block DB5. During a third period t3 of the (N+2)-th frame (N+2)_F, the right-eye data signal R is provided to the second display block DB2 and the black data signal B is provided to the fifth display block DB5. During a third period t3 of the (N+3)-th frame (N+3)_F, the black data signal B is provided to the second display block DB2 and the right-eye data signal R is provided to the fifth display block DB5.

Based on the data signal provided to each of the second and fifth display blocks DB2 and DB5, a second light-emitting signal LBS2 and a fifth light-emitting signal LBS5 for driving the second and fifth light-emitting blocks LB2 and LB5 are respectively provided to the second and fifth light-emitting blocks LB2 and LB5.

The second light-emitting signal LBS2 has the high level during from a fourth period t4 of the N-th frame N_F at which a liquid crystal of the second display block DB2 is responded to the left-eye data signal L to the start of the third period t3 of the (N+1)-th frame (N+1)_F at which the black data signal B is provided to the second display block DB2. The second light-emitting signal LBS2 has the low level during from the third period t3 of the (N+1)-th frame (N+1)_F to the start of a fourth period t4 of the (N+2)-th frame (N+2)_F at which the liquid crystal of the second display block DB2 is responded to the right-eye data signal R. The second light-emitting signal LBS2 has the high level during from a fourth period t4 of the (N+2)-th frame (N+2)_F to the start of the third period t3 of the (N+3)-th frame (N+3)_F at which the black data signal B is provided to the second display block DB2. The second light-emitting signal LBS2 has the low level during from the third period t3 of the (N+3)-th frame (N+3)_F to the start of a fourth period t4 of the (N+4)-th frame (N+4)_F at which the liquid crystal of the second display block DB2 is responded to the left-eye data signal L.

The fifth light-emitting signal LBS5 has the low level during from the third period t3 of the N-th frame N_F to before the fourth period t4 of the (N+1)-th frame (N+1)_F at which the liquid crystal of the fifth display block DB5 is responded to the left-eye data signal L. The fifth light-emitting signal LBS5 has the high level during from the fourth period t4 of the (N+1)-th frame (N+1)_F to before the third period t3 of the (N+2)-th frame (N+2)_F at which the black data signal B is provided to the fifth display block DB5. The fifth light-emitting signal LBS5 has the low level during from the third period t3 of the (N+2)-th frame (N+2)_F to before the fourth period t4 of the (N+3)-th frame (N+3)_F at which the liquid crystal of the fifth display block DB5 is responded to the right-eye data signal R. The fifth light-emitting signal LBS5 has the high level during from the fourth period t4 of the (N+3)-th frame (N+3)_F to before the third period t3 of the (N+4)-th frame (N+4)_F at which the black data signal B is provided to the fifth display block DB5.

Figure 15:
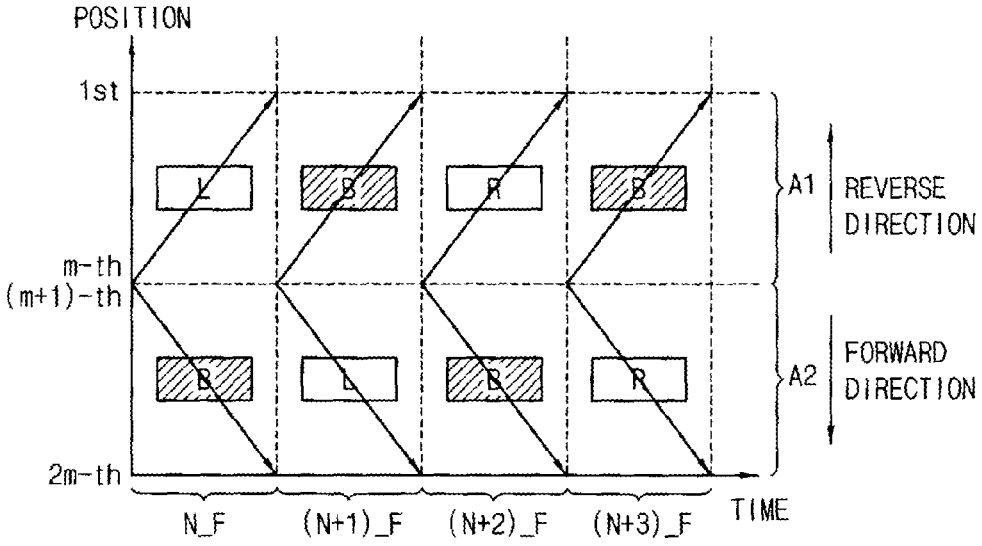
FIG. 15 is a schematic diagram illustrating the method of displaying the 3D stereoscopic image in FIG. 14.

Referring to the method of displaying the 3D image according to FIG. 15 and on the third and sixth display blocks DB3 and DB6, during a fifth period t5 of the N-th frame N_F, a left-eye data signal L is provided to the third display block DB3 and a black data signal B is provided to the sixth display block DB6. During a fifth period t5 of the (N+1)-th frame (N+1)_F, the black data signal B is provided to the third display block DB3 and the left-eye data signal L is provided to the sixth display block DB6. During a fifth period t5 of the (N+2)-th frame (N+2)_F, the right-eye data signal R is provided to the third display block DB3 and the black data signal B is provided to the sixth display block DB6. During a fifth period t5 of the (N+3)-th frame (N+3)_F, the black data signal B is provided to the third display block DB3 and the right-eye data signal R is provided to the sixth display block DB6.

Based on the data signal provided to each of the third and sixth display blocks DB3 and DB6, a third light-emitting signal LBS3 and a sixth light-emitting signal LBS6 for driving the third and sixth light-emitting blocks LB3 and LB6 are respectively provided to the third and sixth light-emitting blocks LB3 and LB6.

The third light-emitting signal LBS3 has the high level during from a sixth period t6 of the N-th frame N_F at which a liquid crystal of the third display block DB3 is responded to the left-eye data signal L to before the fifth period t5 of the (N+1)-th frame (N+1)_F at which the black data signal B is provided to the third display block DB3. The third light-emitting signal LBS3 has the low level during from the fifth period t5 of the (N+1)-th frame (N+1)_F to before a sixth period t6 of the (N+2)-th frame (N+2)_F at which the liquid crystal of the third display block DB3 is responded to the right-eye data signal R. The third light-emitting signal LBS3 has the high level during from a sixth period t6 of the (N+2)-th frame (N+2)_F to before the fifth period t5 of the (N+3)-th frame (N+3)_F at which the black data signal B is provided to the third display block DB3. The third light-emitting signal LBS3 has the low level during from the fifth period t5 of the (N+3)-th frame (N+3)_F to before a sixth period t6 of the (N+4)-th frame (N+4)_F at which the liquid crystal of the third display block DB3 is responded to the left-eye data signal L.

The sixth light-emitting signal LBS6 has the low level during from the fifth period t5 of the N-th frame N_F to before the sixth period t6 of the (N+1)-th frame (N+1)_F at which the liquid crystal of the sixth display block DB6 is responded to the left-eye data signal L. The sixth light-emitting signal LBS6 has the high level during from the sixth period t6 of the (N+1)-th frame (N+1)_F to before the fifth period t5 of the (N+2)-th frame (N+2)_F at which the black data signal B is provided to the sixth display block DB6. The sixth light-emitting signal LBS6 has the low level during from the fifth period t5 of the (N+2)-th frame (N+2)_F to before the sixth period t6 of the (N+3)-th frame (N+3)_F at which the liquid crystal of the sixth display block DB6 is responded to the right-eye data signal R. The sixth light-emitting signal LBS6 has the high level during from the sixth period t6 of the (N+3)-th frame (N+3)_F to before the fifth period t5 of the (N+4)-th frame (N+4)_F at which the black data signal B is provided to the sixth display block DB6.

According to the present exemplary embodiment, the light-source driving part 600 individually controls the light-emitting blocks LB1, LB2, . . . , LB6 based on the data signal respectively provided to the display blocks DB1, DB2, . . . , DB6).

The left-eye shutter signal LSS and the right-eye shutter signal RSS may be substantially the same as those described in FIGS. 3 and 4 and the same detailed explanations are not repeated.

According to the present exemplary embodiment, the display panel 200 is divided into at least the first display area portion A1 and the second display area portion A2, so that the first and second display areas A1 and A2 is simultaneously driven with a relatively low first driving frequency. Otherwise, the display panel 200 may have to be driven with a second driving frequency higher than the first driving frequency. In addition, the number of an integrated circuit included in the data driving part may be decreased in comparison with the previous exemplary embodiment in FIG. 2.

Figure 14:
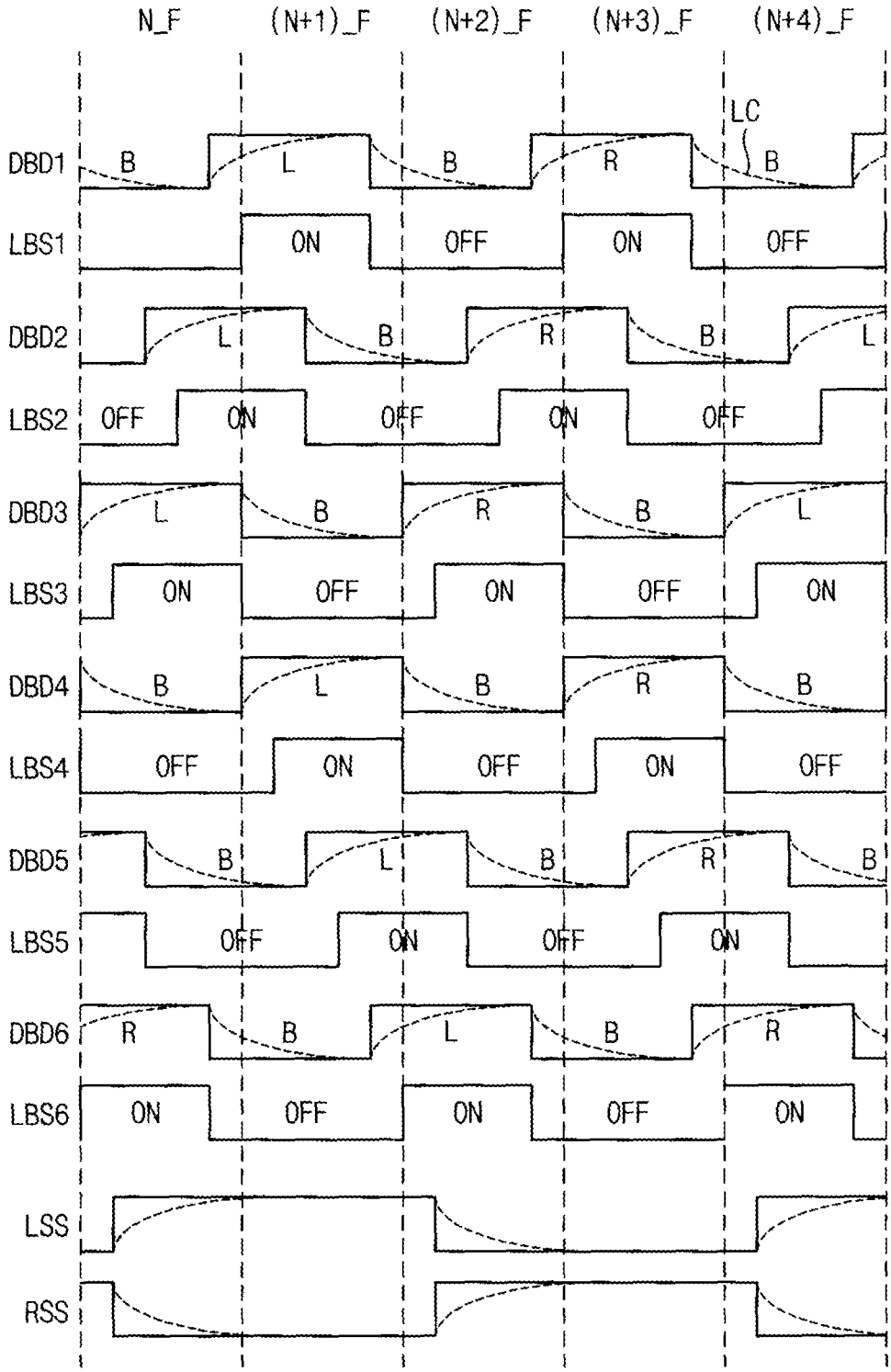
FIG. 14 is a waveform diagram illustrating an exemplary embodiment of a method of displaying a 3D stereoscopic image according to the present disclosure.

FIG. 14 is a timing waveform diagram illustrating an exemplary embodiment of a method of displaying a 3D stereoscopic image according to the present embodiment. FIG. 15 is a schematic diagram illustrating the method of displaying the 3D stereoscopic image in FIG. 14.

Referring to FIGS. 1, 14 and 15, a method of driving the gate driving part 300 according to the present exemplary embodiment may be substantially the same as the described explanations in FIGS. 5 and 6. The first gate circuit part 310 substantially provides gate signals to gate lines disposed in a first display area portion A1 of a display panel 200 along a reverse direction. For example, the first gate circuit part 310 substantially provides the gate signals to m-th to first gate lines GL1, . . . , GLm.

The second gate circuit part 320 sequentially provides gate signals to gate lines disposed in a second display area portion A2 of the display panel 200 along a forward direction in synchronization with the first gate circuit part 310. For example, the second gate circuit part 320 substantially provides the gate signals to (m+1)-th to 2m-th gate lines GLm+1, . . . , GL2*m*.

The data driving part 430 according to the present exemplary embodiment may be substantially driven the same as the described in FIGS. 13A and 13B. When the data driving part 430 provides the left-eye data signal or the right-eye data signal to the first display area portion A1 of the display panel 200, the data driving part 430 provides the black data signal to the second display area portion A2 of the display panel 200. However, when the data driving part 430 provides the black data signal to the first display area portion A1 of the display panel 200, the data driving part 430 provides the left-eye data signal or the right-eye data signal to the second display area portion A2 of the display panel 200.

Referring to a method of displaying the 3D image on the third and fourth display blocks DB3 and DB4, during a first period t1 of an N-th frame N_F, a left-eye data signal L is provided to the third display block DB3 and a black data signal B is provided to the fourth display block DB4. During a first period t1 of an (N+1)-th frame (N+1)_F, the black data signal B is provided to the third display block DB3 and the left-eye data signal L is provided to the fourth display block DB4. During a first period t1 of an (N+2)-th frame (N+2)_F, the right-eye data signal R is provided to the third display block DB3 and the black data signal B is provided to the fourth display block DB4. During a first period t1 of an (N+3)-th frame (N+3)_F, the black data signal B is provided to the third display block DB3 and the right-eye data signal R is provided to the fourth display block DB4.

Based on the data signal provided to each of the third and fourth display blocks DB3 and DB4, a third light-emitting signal LBS3 and a fourth light-emitting signal LBS4 for driving the third and fourth light-emitting blocks LB3 and LB4 are respectively provided to the third and fourth light-emitting blocks LB3 and LB4.

The third light-emitting signal LBS3 may have a phase that is substantially the same as a phase of the third light-emitting signal LBS3 described in FIG. 11 and the fourth light-emitting signal LBS4 may have a phase that is substantially the same as a phase of the fourth light-emitting signal LBS4 described in FIG. 11. Thus, the same detailed explanations are not repeated.

A method of displaying the 3D image on the second and fifth display blocks DB2 and DB5, may be substantially the same as those described in FIGS. 11 and 12 and the same detailed explanations are not repeated.

Referring to a method of displaying the 3D image on the first and sixth display blocks DB1 and DB6, during a third period t3 of an N-th frame N_F, the left-eye data signal L is provided to the first display block DB1 and the black data signal B is provided the sixth display block DB6. During a fifth period t5 of an (N+1)-th frame (N+1)_F, the black data signal B is provided to the first display block DB1 and the left-eye data signal L is provided to the sixth display block DB6. During a fifth period of an (N+2)-th frame (N+2)_F, the right-eye data signal R is provided to the first display block DB1 and the black data signal B is provided to the sixth display block DB6. During a fifth period t5 of an (N+3)-th frame (N+3)_F, the black data signal B is provided to the first display block DB1 and the right-eye data signal R is provided to the sixth display block DB6.

Based on the data signal provided to each of the first and sixth display blocks DB1 and DB6, a first light-emitting signal LBS1 and a sixth light-emitting signal LBS6 for driving the first and sixth light-emitting blocks LB1 and LB6 are respectively provided to the first and sixth light-emitting blocks LB1 and LB6.

The first light-emitting signal LBS1 may have a phase that is substantially the same as a phase of the first light-emitting signal LBS1 described in FIG. 11 and the sixth light-emitting signal LBS6 may have a phase that is substantially the same as a phase of the sixth light-emitting signal LBS6 described in FIG. 11. Thus, the same detailed explanations are not repeated.

The left-eye shutter signal LSS and the right-eye shutter signal RSS may be substantially the same as those described in FIGS. 3 and 4 and the same detailed explanations are not repeated unless necessary.

According to the present exemplary embodiment, the display panel 200 is divided into at least the first display area portion A1 and the second display area portion A2, so that the first and second display areas A1 and A2 is simultaneously driven with a relatively low first driving frequency. Otherwise, the display panel 200 may have to be driven with a second driving frequency higher than the first driving frequency. In addition, the number of an integrated circuit included in the data driving part may be decreased in comparison with the previous exemplary embodiment in FIG. 2.

Figure 16:
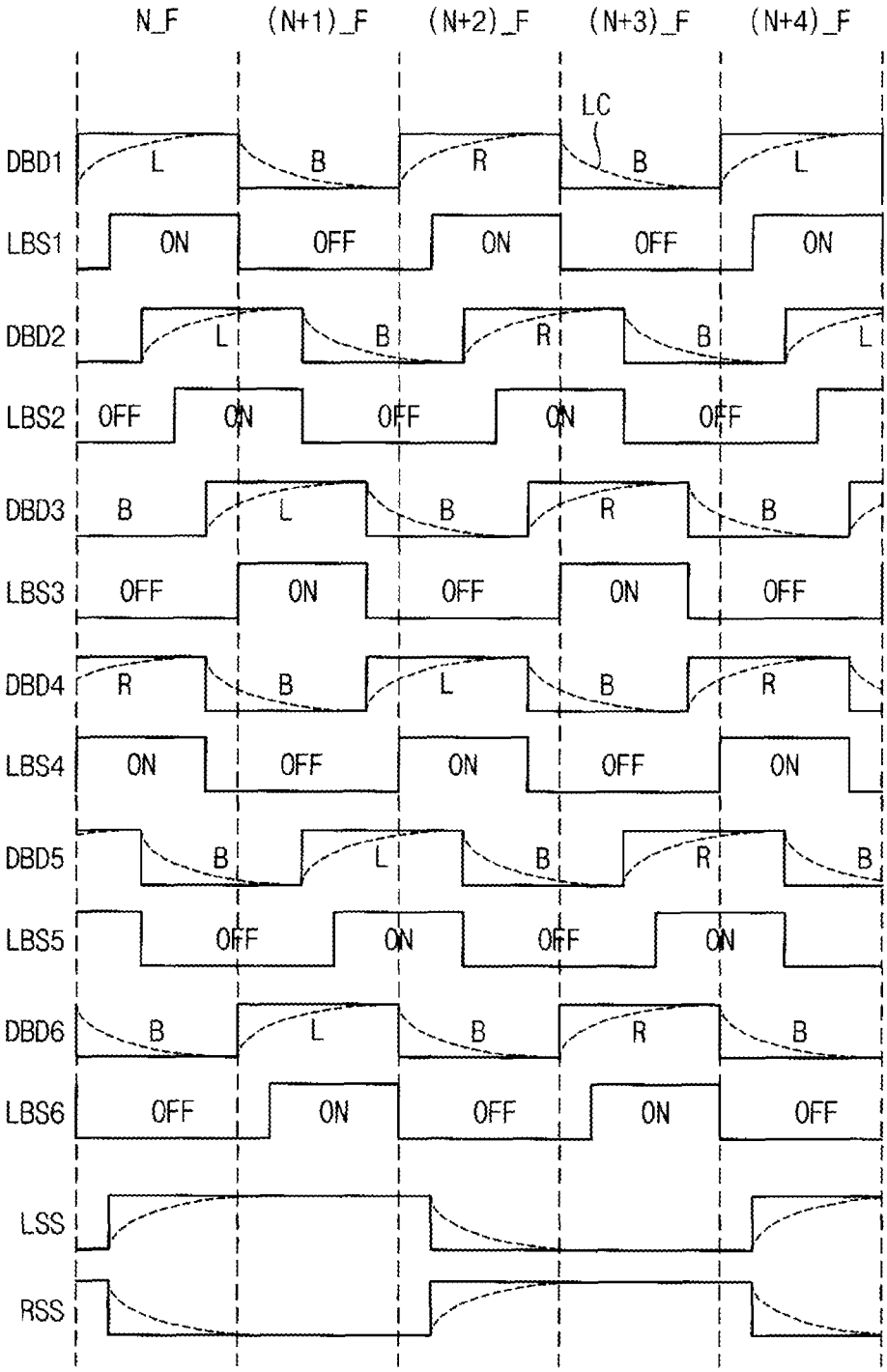
FIG. 16 is a waveform diagram illustrating an exemplary embodiment of a method of displaying a 3D stereoscopic image according to the present disclosure.
Figure 17:
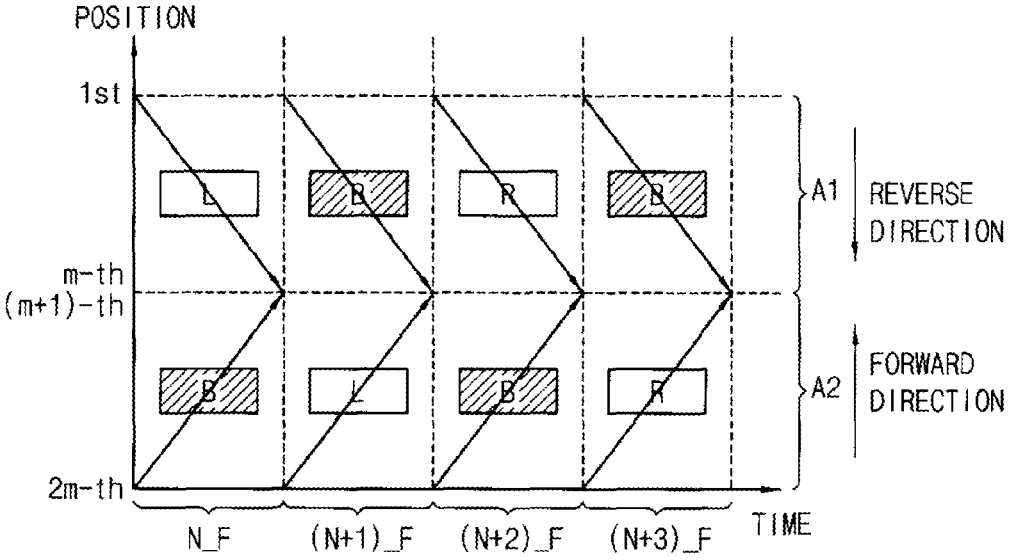
FIG. 17 is a schematic diagram illustrating the method of displaying the 3D stereoscopic image in FIG. 16.

FIG. 16 is a timing waveform diagram illustrating an exemplary embodiment of a method of displaying a 3D stereoscopic image according to the present disclosure. FIG. 17 is a schematic diagram illustrating the method of displaying the 3D stereoscopic image in FIG. 16.

Referring to FIGS. 1, 16 and 17, a method of driving the gate driving part 300 according to the present exemplary embodiment may be substantially the same as the described explanations in FIGS. 7 and 8. The first gate circuit part 310 substantially provides gate signals to gate lines disposed in a first display area portion A1 of a display panel 200 along a forward direction. For example, the first gate circuit part 310 substantially provides the gate signals to first to m-th gate lines GL1, . . . , GLm.

The second gate circuit part 320 sequentially provides gate signals to gate lines disposed in a second display area portion A2 of the display panel 200 along a reverse direction in synchronization with the first gate circuit part 310. For example, the second gate circuit part 320 substantially provides the gate signals to 2m-th to (m+1)-th gate lines GL2*m*, . . . , GLm+1.

The data driving part 430 according to the present exemplary embodiment may be substantially driven the same as the described in FIGS. 13A and 13B. When the data driving part 430 provides the left-eye data signal or the right-eye data signal to the first display area portion A1 of the display panel 200, the data driving part 430 provides the black data signal to the second display area portion A2 of the display panel 200. However, when the data driving part 430 provides the black data signal to the first display area portion A1 of the display panel 200, the data driving part 430 provides the left-eye data signal or the right-eye data signal to the second display area portion A2 of the display panel 200.

Referring to a method of displaying the 3D image on the first and sixth display blocks DB1 and DB6, during a first period t1 of an N-th frame N_F, the left-eye data signal L is provided to the first display block DB1 and the black data signal B is provided to the sixth display block DB6. During a first period t1 of an (N+1)-th frame (N+1)_F, the black data signal B is provided to the first display block DB1 and the left-eye data signal L is provided to the sixth display block DB6. During a first period t1 of an (N+2)-th frame (N+2)_F, the right-eye data signal R is provided to the first display block DB1 and the black data signal B is provided to the sixth display block DB6. During a first period t1 of an (N+3)-th frame (N+3)_F, the black data signal B is provided to the first display block DB1 and the right-eye data signal R is provided to the sixth display block DB6.

Based on the data signal provided to each of the first and sixth display blocks DB1 and DB6, a first light-emitting signal LBS1 and a sixth light-emitting signal LBS6 for driving the first and sixth light-emitting blocks LB1 and LB6 are respectively provided to the first and sixth light-emitting blocks LB1 and LB6.

The first light-emitting signal LBS1 may have a phase that is substantially the same as a phase of the first light-emitting signal LBS1 described in FIG. 11 and the sixth light-emitting signal LBS6 may have a phase that is substantially the same as a phase of the sixth light-emitting signal LBS6 described in FIG. 11. Thus, the same detailed explanations are not repeated.

A method of displaying the 3D image on the second and fifth display blocks DB2 and DB5, may be substantially the same as those described in FIGS. 11 and 12 and the same detailed explanations are not repeated.

Referring to a method of displaying the 3D image on the third and fourth display blocks DB3 and DB4, during a fifth period t5 of the N-th frame N_F, the left-eye data signal L is provided to the third display block DB3 and the black data signal B is provided to the fourth display block DB4. During a fifth period t5 of the (N+1)-th frame (N+1)_F, the black data signal B is provided to the third display block DB3 and the left-eye data signal L is provided to the fourth display block DB4. During a fifth period t5 of the (N+2)-th frame (N+2)_F, the right-eye data signal R is provided to the third display block DB3 and the black data signal B is provided to the fourth display block DB4. During a fifth period t5 of the (N+3)-th frame (N+3)_F, the black data signal B is provided to the third display block DB3 and the right-eye data signal R is provided to the fourth display block DB4.

Based on the data signal provided to each of the third and fourth display blocks DB3 and DB4, a third light-emitting signal LBS3 and a fourth light-emitting signal LBS4 for driving the third and fourth light-emitting blocks LB3 and LB4 are respectively provided to the third and fourth light-emitting blocks LB3 and LB4.

The third light-emitting signal LBS3 may have a phase that is substantially the same as a phase of the third light-emitting signal LBS3 described in FIG. 11 and the fourth light-emitting signal LBS4 may have a phase that is substantially the same as a phase of the fourth light-emitting signal LBS4 described in FIG. 11. Thus, the same detailed explanations are not repeated.

A method of displaying the 3D image on the second and fifth display blocks DB2 and DB5, may be substantially the same as those described in FIGS. 11 and 12 and the same detailed explanations are not repeated.

Figure 18:
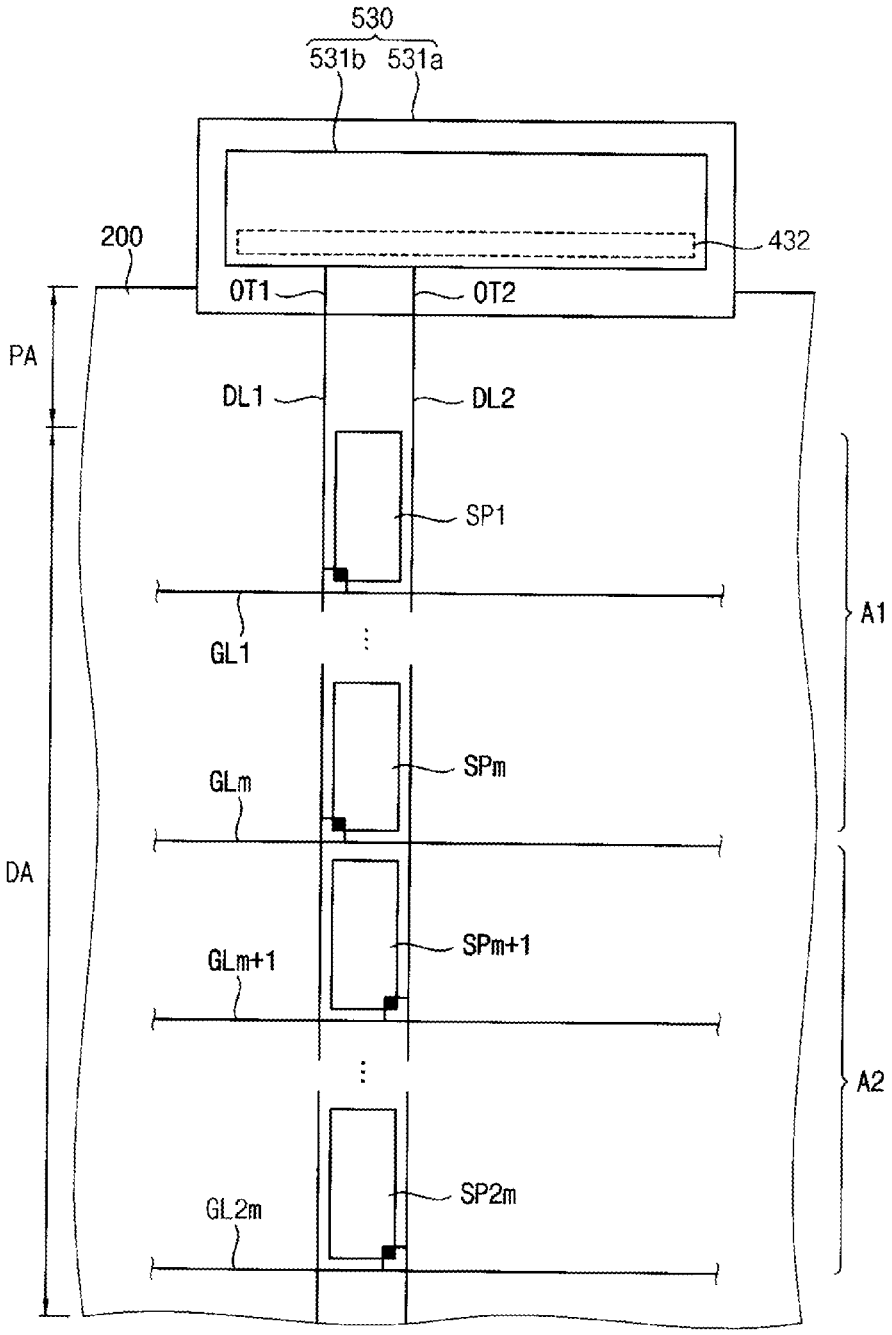
FIG. 18 is a plan view illustrating an exemplary embodiment of a display apparatus according to the present disclosure.

FIG. 18 is a plan view illustrating an exemplary embodiment of a display apparatus according to another embodiment of the present disclosure of invention.

Referring to FIGS. 10 and 18, the display apparatus according to the present exemplary embodiment includes elements that may be substantially the same as other elements except for a data driving part 530 in comparison with the display apparatus according to the pervious exemplary embodiment described in FIG. 10, and the same detailed explanations are not repeated.

The data driving part 530 is mounted in the peripheral area PA corresponding to a long-side of the display panel 200. The data driving part 531 includes a FPCB 531*a* and an integrated circuit 531*b* mounted on the FPCB 531*a*.

The integrated circuit 531*b* included the data selection part 432 described in FIG. 10. The data selection part 432 may include a first switching part SW1, a second switching part SW2, a plurality of control lines CL1, CL2, CL3 and CL4 and a voltage line VL.

Thus, a first outputting terminal OT1 of the data driving part 531 is connected to a first data line DL1 and a second outputting terminal OT2 of the data driving part 531 is connected to a second data line DL2.

The sub pixels SP1, . . . , SPm of a first group disposed in the first display area portion A1 among the sub pixels included in the pixel column PC are electrically connected to the first data line DL1 and the sub pixels SPm+1, . . . , SP2*m* of a second group disposed in the second display area portion A2 among the sub pixels included in the pixel column PC are electrically connected to the second data line DL2.

A method of displaying the 3D image according to the present exemplary embodiment, may be substantially the same as the described explanations in FIGS. 11 to 17 and the same detailed explanations are not repeated.

Although not shown in figures, the first gate circuit part 310 may sequentially provide gate signals to m-th to first gate lines GLm, . . . , GL1 along a reverse direction, and the second gate circuit part 320 may sequentially provide gate signals to 2m-th to (m+1)-th gate lines GL2*m*, . . . , GLm+1 in synchronization with a driving timing of the first gate circuit part 310. A method of displaying the 3D image may be substantially the same as the previous exemplary embodiments.

According to the present exemplary embodiments, the display panel 200 is divided into at least the first display area portion A1 and the second display area portion A2 along a scanning direction and the first and second display areas A1 and A2 are simultaneously driven, so that a frame frequency of the display panel 200 *t* be increased.

The foregoing is illustrative of the present teachings and is not to be construed as limiting thereof. Although a few exemplary embodiments of the present disclosure of invention have been described, those skilled in the art will readily appreciate in light of the foregoing that many modifications are possible in the exemplary embodiments without materially departing from the novel teachings and advantages of the present disclosure. Accordingly, all such modifications are intended to be included within the scope of the present teachings. In the claims, means-plus-function clauses are intended to cover the structures described herein as performing the recited function and not only structural equivalents but also functionally equivalent structures. Therefore, it is to be understood that the foregoing is illustrative of the present disclosure of invention and is not to be construed as limited to the specific exemplary embodiments disclosed, and that modifications to the disclosed exemplary embodiments, as well as other exemplary embodiments, are intended to be included within the scope of the teachings.

What is claimed is:

1. A machine-implemented method of displaying a three-dimensional ("3D") stereoscopic image by way of a display panel having a display area subdivided into at least first and second display area portions, wherein the display panel has first data lines configured to provide image data to the first display area portion but not to the second display area portion and the display panel has second data lines configured to provide image data to the second display area portion but not to the first display area portion, the method comprising:

first providing a respective first 3D data signal by way of one or more of the first data lines for rendering corresponding first imagery on the first display area portion of a display panel; and second and selectively providing by way of one or more of the second data lines, one or the other of a respective second 3D data signal and a black data signal for rendering corresponding imagery or blackness on the second display area portion of the display panel in synchronism with the first providing of the first 3D data signal for rendering the corresponding first imagery on the first display area portion;

wherein the first 3D data signal corresponds with a first of left and right eye imagery and the second 3D data signal corresponds with a second of the left and right eye imagery.

2. The method of claim 1, wherein:

the selected one of the second 3D data signal or the black data signal of the second providing step is sequentially provided in a spatially progressive manner for rendering on the second display area portion along a first spatial direction, and the first 3D data signal of the first providing step is sequentially provided in a spatially progressive manner for rendering on the first display area portion also along the first spatial direction.

3. The method of claim 1, wherein:

said first providing includes an alternative selective providing of the black data signal for rendering on the first display area portion instead of providing the first 3D data signal, and the selectively provided one of the first 3D data signal or the black data signal is sequentially provided in a spatially progressive manner for rendering on the first display area portion along a first spatial direction, and the selected one of the second 3D data signal or the black data signal is sequentially provided for rendering on the second display area portion along a second spatial direction which is opposite to (the reverse of) the first direction.

4. The method of claim 1, wherein the second 3D data signal is sequentially provided to the second display area portion when the first 3D data signal is sequentially provided to the first display area portion.

5. The method of claim 4, further comprising:

thirdly providing the black data signal to the first display area portion of the display panel; and wherein the second and selective providing includes providing the black data signal to the second display area portion when the black data signal is being provided to the first display area portion.

6. The method of claim 1, further comprising:

simultaneously controlling with a same first turn on-or-off control signal, respective ones of a first light-emitting block and a second light-emitting block respectively corresponding to a first display block disposed in the first display area portion and a second display block disposed the second display area portion, where the first and second display blocks simultaneously receive one or the other of the corresponding 3D data signal or the black data signal in synchronism with the respective first and second light-emitting block being simultaneously controlled to be turned on-or-off by the first turn on-or-off control signal.

7. The method of claim 1, wherein the black data signal is sequentially provided to the second display area portion when the first 3D data signal is being sequentially provided to the first display area portion.

8. The method of claim 1, further comprising:

providing the black data signal for rendering on the first display area portion; and providing the second 3D data signal for rendering on the second display area portion when the black data signal is being provided to the first display area portion.

9. The method of claim 1, wherein the first and second display area portions are spatially arranged along a scanning direction of sequentially provided gate line activating signals.

10. A display apparatus comprising:

a display panel;

a first gate circuit part configured to sequentially provide a plurality of first gate signals to a corresponding plurality of first gate lines of a respective first group of gate lines disposed in a first display area portion of the display panel;

a second gate circuit part configured to sequentially provide a plurality of second gate signals to a corresponding plurality of second gate lines of a respective second group of gate lines disposed in a second display area portion of the display panel when the first gate signals are being sequentially provided to the gate lines of the first group;

a data driving part configured to provide a first 3D data signal for rendering on the first display area portion in synchronization with the first gate signals, and to selectively provide a second 3D data signal or a black data signal for rendering on the second display area in synchronization with the second gate signals; and a light-source part including a plurality of selectively activatable light-emitting blocks which are configured to provide backlighting for the display panel;

wherein the first 3D data signal corresponds with a first of left and right eye imagery and the second 3D data signal corresponds with a second of the left and right eye imagery; and wherein the display panel has first data lines configured to provide image data to the first display area portion but not to the second display area portion and the display panel has second data lines configured to provide image data to the second display area portion but not to the first display area portion.

11. The display apparatus of claim 10, wherein the first gate circuit part is configured to sequentially provide the first gate signals to the gate lines of the first group along a first spatial direction, and the second gate circuit part is configured to sequentially provide, in at least one mode, the second gate signals to the gate lines of the second group along the same first spatial direction.

12. The display apparatus of claim 10, wherein the first gate circuit part is configured to sequentially provide the first gate signals to the gate lines of the first group along a first direction, and the second gate circuit part is configured to sequentially provide, in at least one mode, the second gate signals to the gate lines of the second group along a second spatial direction opposite to the first spatial direction.

13. The display apparatus of claim 10, wherein the data driving part includes:

a first data circuit part disposed adjacent to a first long-side edge of the display panel and configured to provide first data signals to pixels of the first display area portion; and a second data circuit part disposed adjacent to a second long-side edge of the display panel and configured to provide second data signals to pixels of the second display area portion, and wherein the first display area portion is located between the first data circuit part and the second display area portion, and the second display area portion is located between the second data circuit part and the first display area portion.

14. The display apparatus of claim 13, wherein when the first data circuit part is configured to provide the first 3D data signal for rendering on the first display area portion, the second data circuit part is configured to provide the second 3D data signal for rendering on the second display area portion, and wherein the second data circuit part is configured to provide the black data signal to the second display area portion when the first data circuit part is providing the black data signal to the first display area portion.

15. The display apparatus of claim 14, further comprising:

a light-source driving part configured to simultaneously control the turning on and off of both a first light-emitting block and a second light-emitting block respectively disposed in correspondence to a first display block of the first display area portion and a second display block of the second display area portion where the first and second display blocks simultaneously receive either their respective first and second 3D data signals or the black data signal.

16. The display apparatus of claim 10, wherein the display panel includes:

a first data line electrically connected to sub-pixels disposed in the first display area portion among sub-pixels included in a pixel column; and a second data line electrically connected to the sub-pixels disposed in the second display area portion among the sub-pixels included in the same pixel column.

17. The display apparatus of claim 16, wherein the data driving part includes:

an integrated circuit part disposed in a peripheral area adjacent to a long-side edge of the display panel and configured for outputting the first and second 3D data signals; and a data selection part disposed in the peripheral area of the display panel and configured for selectively providing respective ones of the first and second 3D data signals or the black data signal to the first and second data lines.

18. The display apparatus of claim 17, wherein the data selection part includes:

a voltage line disposed in the peripheral area of the display panel and coupled for providing the black data signal;

a first switching part configured for selectively connecting an output terminal of the integrated circuit part with the first and second data lines; and a second switching part configured for selectively connecting the voltage line with the first and second data lines, wherein when the first switching part connects the first data line with the output terminal, the second switching part connects the second data line with the voltage line, and wherein the second switching part connects the first data line with the voltage line, when the first switching part connects the second data line with the output terminal.

19. The display apparatus of claim 10, wherein the first and second display area portions are arranged along a column direction of the display panel.

20. The display apparatus of claim 17, wherein the data driving part includes:

a flexible printed circuit board (FPCB) disposed in the peripheral area adjacent to a long-side edge of the display panel; and a data selection part disposed on the FPCB and configured for selectively providing one of the first and second 3D data signals and the black data signal respectively to the first and second data lines.

* * * * *